US005234801A

United States Patent [19]

Ishikawa

[11] Patent Number: 5,234,801

[45] Date of Patent: Aug. 10, 1993

[54] PROCESSING OF SILVER HALIDE COLOR PHOTOGRAPHIC MATERIAL

[75] Inventor: Takatoshi Ishikawa, Kanagawa, Japan

[73] Assignee: Fuji Photo Film Co., Ltd., Kanagawa, Japan

[21] Appl. No.: 840,585

[22] Filed: Feb. 26, 1992

Related U.S. Application Data

[63] Continuation of Ser. No. 556,513, Jul. 24, 1990, abandoned.

[30] Foreign Application Priority Data

Jul. 24, 1989 [JP] Japan ..... 1-188847

[51] Int. Cl.[5] ..... G03C 7/42

[52] U.S. Cl. ..... 430/400; 430/393; 430/460

[58] Field of Search ..... 430/393, 398, 400, 430, 430/460

[56] References Cited

U.S. PATENT DOCUMENTS

| | | | |
|---|---|---|---|
| H789 | 6/1990 | Ueda et al. | 430/400 |
| 3,879,203 | 4/1975 | Schranz et al. | 430/400 |
| 4,128,464 | 12/1978 | Idota | 430/400 |
| 4,756,918 | 7/1988 | Ueda et al. | 430/400 |
| 4,818,673 | 4/1989 | Ueda et al. | 430/435 |
| 4,914,007 | 4/1990 | Fujita et al. | 430/336 |
| 4,954,426 | 9/1990 | Ishikawa | 430/400 |

FOREIGN PATENT DOCUMENTS

| | | | |
|---|---|---|---|
| 139334 | 1/1976 | Japan . | |
| 53-35534 | 4/1978 | Japan . | |
| 77743 | 6/1980 | Japan | 430/400 |
| 79446 | 6/1980 | Japan | 430/400 |
| 195545 | 10/1986 | Japan | 430/400 |
| 63-46460 | 2/1988 | Japan . | |
| 63-280248 | 11/1988 | Japan . | |

OTHER PUBLICATIONS

Chelates of Polyaminocarboxylic Acids, Joan Bond and T. I. Jones, pp. 1310–1318, Chemistry Dept., Royal Technical College, Peel Park, Salford 5, Jan. 1959.

RD 10150 "Method for preparing bleach-fix regenerator calculate", Sep. 1972, pp. 76–77.

*Primary Examiner*—Hoa Van Le

*Attorney, Agent, or Firm*—Sughrue, Mion, Zinn, Macpeak & Seas

[57] ABSTRACT

A method for continuously processing an image-wise exposed silver halide color photographic material comprising the steps of color developing, bleach-fixing and at least one of washing with water and stabilizing. A replenisher is supplied to the bleach-fix bath to result in an overflow of from 30 to 500 ml/m$^2$ of the photographic material processed. The bleach-fixing step further comprises collecting the bleach-fix overflow, regenerating the collected bleach-fix bath overflow by adding thereto a regenerant to produce a regenerated bleach-fix bath, and reusing the regenerated bleach-fix bath as a replenisher to the bleach-fix bath. The regeneration rate defined as the amount of bleach-fix overflow used for regeneration divided by the total amount of overflow multiplied by 100% is more than 80%. The photographic layers of the silver halide color photographic material have a degree of swelling of from about 2.5 to 4.0. The silver halide color photographic material further has a silver coverage of less than about 0.8 g/m$^2$. The above described method solves problems of poor desilvering, inadequate color reproduction and undesirable cyan thermal discoloration which generally accompany reuse of the bleach-fixing bath.

10 Claims, No Drawings

PROCESSING OF SILVER HALIDE COLOR PHOTOGRAPHIC MATERIAL

This is a continuation of application No. 07/556,513 filed Jul. 24, 1990, now abandoned.

FIELD OF THE INVENTION

This invention relates to a method for processing a silver halide color photographic material and, more particularly to a continuous processing method in which a spent bleach-fix bath is reused as a replenisher in order to reduce both cost and the amount of waste liquid and a running cost.

BACKGROUND OF THE INVENTION

During the processing of silver halide color photographic materials, spent processing solutions are generally recovered and discarded as an overflow. However, the recovery and discarding of spent processing solutions can cause substantial environmental pollution and prevents conservation of natural resources used to produce these solutions. Also, recovery costs are significant. If these spent processing solutions (overflows) could be reused as a replenisher, these environmental and economical problems could be solved. In addition, since active components remaining in the overflow could be re-utilized, the amounts of chemicals needed for preparing a replenisher would be reduced as compared to preparing a fresh replenisher, thereby further reducing the cost of processing. Hence, extensive processing solutions in order make them reusable by correcting the changes caused by processing, generally by removal of accumulated components which adversely affect photographic properties and replacing the consumed components.

With respect to a bleach-fix bath used for processing of color photographic materials, various efforts have been made in order to develop techniques for regenerating spent bleach-fix bath.

A bleach-fix bath generally contains chemicals for at least three functions, e.g., an aminopolycarboxylic acid iron (III) complex serving as a bleaching agent, a thiosulfate serving as a fixing agent, and a sulfite serving as a preservative. The overflow of the bleach-fix bath additionally contains a silver ion produced by desilvering action and color developer components which have been carried over from the prebath. At the same time, the overflow further contains an iron (II) aminopolycarboxylate resulting from oxidation of silver to silver ion.

As described above, regeneration of a processing solution generally requires removal of harmful accumulated components and addition of consumed components. However, long standing problems remain effectively removing the accumulated components. In order to solve this problem, various regeneration systems for removing or reducing a silver ion resulting from desilvering have been proposed.

A regeneration method in which a spent bleach-fix bath is contacted with metallic iron (steel wool) is disclosed in *Radiography*, Vol. 29, pp. 256–259 (1963) and JP-A-48-3624 (the term "JP-A" as used herein means an "unexamined published Japanese patent application"). According to this method, while silver ion contacted with a metallic ion is recovered as metallic silver to reduce the silver ion concentration, metallic iron is dissolved into a bleach-fix bath (as a strongly reducing iron (II) ion) thereby weakening the oxidizing ability of the bath. As regeneration is repeated, the dissolved metallic iron causes a large variation in the iron ion concentration, making it difficult to stably control the overall ion concentration. The more one tries to reduce the silver ion concentration, the more likely one is to encounter this problem.

A method for reducing a silver ion by electrolysis is described in JP-B-53-40491 (the term "JP-B" as used herein means an "examined published Japanese patent application"), JP-A-51-19535, JP-A-51-36136, and U.S. Pat. No. 4,014,764. In this case, too, either an iron (III) complex is reduced to an iron (II) complex or a sulfite ion is oxidized to a sulfate ion at the anode, which seriously fatigues the processing solution and, at the same time, reduces stability of the solution. This problem becomes more conspicuous as the amount of electricity is increased to raise the rate of silver recovery and to reduce the silver ion concentration in the bleach-fix bath.

A technique for removing a silver complex by adsorption onto an ion exchange resin is proposed in *J. Appl. Photogr. Eng.*, Vol. 6, pp. 14–18 (1980). However, this method involves complicated operations for releasing an adsorbed silver complex from the resin to regenerate the resin. Additionally, it has the problems of producing large quantities of waste liquid and having a high operating cost.

Thus, conventional techniques for removing or reducing unnecessary components from a spent processing solution to make the solution reusable generally suffer from the problems of a lack of control of the final ratio of components the inability to analyze the components, the need for complex regeneration steps, and the requirement for large-sized equipment for regeneration.

JP-B-56-33697 and JP-A-50-145231 disclose a technique for regenerating an overflow, in which silver is not positively removed, but, when necessary, an equilibrium amount of accumulated silver ion is relatively reduced, for example, by dilution. This method is simple, easy, and cheap to carry out as requiring no special equipment for silver recovery.

However, this method, when used alone, has been bound to delay the desilvering step due to the accumulation of silver bromide precipitating out in large quantities and the additional accumulation of sulfate which, eventually, tends to cause an undesired staining, due to accumulation of developer components or poor color reproduction, thus suffering from the problem of unstable operating performance. When this method is utilized, particularly for reuse of a bleach-fix bath, there is accumulation of (1) a halide ion and silver ion, (2) an iron (II) aminopolycarboxylate and, (3) developer components or sulfate, resulting from oxidation of sulfite ion. It appears that some or all of these accumulated components act on each other, resulting in one or more of delayed desilvering, formation of a leuco cyan dye (which leads to poor color reproduction), deterioration of image preservability, and/or a particular thermal discoloration of a cyan dye. Such problems become more pronounced as a result of rapid processing.

Therefore, development of a technique for regenerating an overflow generally encounters difficulty and, in particular, regeneration of a bleach-fix bath remains problematic, due to the deterimental action of the components contained or accumulated.

In another context, JP-A-63-46460 discloses an image formation method in which a light-sensitive material having a specific degree of swelling (i.e., quotient obtained by dividing a wet thickness of photographic layers after immersion in distilled water at about 33° C. for about 2 minutes by a thickness after drying) is used. According to this method, it is asserted that image preservability is not impaired (specifically, stain increase and light discoloration of a magenta dye are inhibited) even if the time for washing with water is reduced. However, this technique aims to solve the problems arising from insufficient washing of bleaching components and fixing components when the washing time is reduced. However, there is no suggestion of possible solutions to the above-described problems arising due to the accumulation of various components in a bleach-fix bath through repeated regeneration and reuse of a bleach-fix bath, such as insufficient desilvering, poor color reproduction, and thermal discoloration by a cyan image.

SUMMARY OF THE INVENTION

An object of this invention is to provide a method for processing a silver halide color photographic material which causes insufficient desilvering, poor color reproduction, or thermal discoloration by a cyan dye, even when a bleach-fix bath is repeatedly regenerated and reused as a replenisher.

It has now been found that the above object of this invention is accomplished by a method for processing a silver halide color photographic material comprising the steps of (a) colour developing, (b) bleach-fixing, and (c) at least one of (i) washing with water and (ii) stabilizing, comprising regenerating a spent bleach-fix bath by adding a regenerant and reusing such regenerated bleach-fix replenisher, wherein said photographic layers of said silver halide color photographic material have a degree of swelling of from about 2.5 to 4.0; and said silver halide color photographic material has a silver coverage of less than about 0.80 g/m$^2$.

DETAILED DESCRIPTION OF THE INVENTION

This invention is based on the finding that various components are substantially accumulated during regeneration and reuse of a spent processing solution are resulting in the above-described. It has been discovered that various accumulated components unexpectedly retard swelling of a light-sensitive material in a bleach-fix bath, thereby resulting in such problems. These problems are surprisingly solved by adjusting the degree of swelling of photographic layers of a light-sensitive material to a specific range and, also, by reducing the silver coverage of the light-sensitive material.

It has been shown that sufficient desilvering performance and satisfactory image quality can be assured even if a spent processing solution (overflow) is repeatedly reused as a regenerated replenisher simply by adding supplementing a spent components as a so-called regenerant with no need to positively remove or reduce unnecessary accumulated components (e.g., silver ion) from the overflow.

Further, it has also been found that the above-mentioned color reproducibility of a silver halide color photographic material is greatly improved when the material contains at least one cyan coupler represented by formula (I):

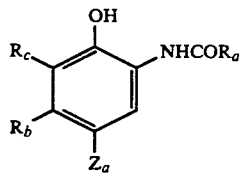

(I)

wherein $R_a$ represents an alkyl group, a cycloalkyl group, an aryl group, an amino group, or a heterocyclic group; $R_b$ represents an acylamino group or an alkyl group having 2 or more carbon atoms; $R_c$ represents a hydrogen atom, a halogen atom, an alkyl group, or an alkoxy group; $R_c$ and $R_b$ may be taken together to form a ring; and $Z_a$ represents a hydrogen atom, a halogen atom, or a group releasable on reacting with an oxidation product of an aromatic primary amine color developing agent.

A color developing solution which can be used for development processing of light-sensitive materials preferably includes an alkaline aqueous solution containing an aromatic primary amine color developing agent as a main component. Useful color developing agents include aminophenol compounds and, preferably, p-phenylenediamine compounds. Typical examples of p-phenylenediamine developing agents are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline, and sulfates, hydrochlorides or p-toluenesulfonates thereof. If desired, these compounds may be used in combination of two or more thereof.

A color developing solution, used according to a method of the present invention can contain a pH buffer, e.g., alkali metal carbonates, borates or phosphates; and development inhibitors or antifoggants, e.g., bromides, iodides, benzimidazoles, benzothiazoles, and mercapto compounds. A color developing solution of the present invention further can contain various preservatives, e.g., hydroxylamine, diethylhydroxylamine, hydrazine sulfites, phenyl semicarbazides, triethanolamine, catecholsulfonic acids, and triethylenediamine(1,4-diazabicyclo[2,2,2]octane); organic solvents, e.g., ethylene glycol and diethylene glycol; development accelerators, e.g., benzyl alcohol, polyethylene glycol, quaternary ammonium salts, and amines; dye forming couplers; competing couplers; fogging agents, e.g., sodium borohydride; auxiliary developing agents, e.g., 1-phenyl-3-pyrazolidone; tackifiers; and various chelating agents, e.g., aminopolycarboxylic acids, aminopolyphosphonic acids, alkylphosphonic acids, and phosphonocarboxylic acids. Specific examples of the chelating agents are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

It should be noted, however, that a color developing solution of the present invention preferably contains substantially no benzyl alcohol. The term "substantially no benzyl alcohol" means that the benzyl alcohol content in a color developing solution is not more than about 2 ml/l, and preferably zero.

Where reversal development is used according to a method of the present invention, color development can be generally preceded by black-and-white development. A black-and-white developing solution to be used according to the present invention, can contain one or more of known black-and-white developing agents, such as dihydroxybenzenes, e.g., hydroquinone; 3-pyrazolidones, e.g., 1-phenyl-3-pyrazolidone; and aminophenols, e.g., N-methyl-p-aminophenol.

A color developing solution and black-and-whit developing solution of the present invnetion generally has a pH of from about 9 to 12. A rate of replenishment for these developing solutions can be usually about 3 l per $m^2$ of a light-sensitive material, although this rate can vary depending on the type of the light-sensitive material. A replenishment rate may be reduced to about 500 $ml/m^2$ or less, or even to about 150 $ml/m^2$ or less, by reducing a bromide ion concentration or a chloride ion concentration in the replenisher. In the case of reducing the replenishment rate, it is preferable to prevent evaporation or air oxidation of the replenisher by minimizing the liquid surface area of the processing tank in contact with air. Reduction of the replenishment rate may also be achieved by using a means for suppressing accumulation of a bromide ion in the developing solution. The process may generally be carried out, for example, by applying an electric dialysis, disclosed in JP-A-51-85722, JP-A-54-37731, JP-A-56-1049, JP-A-56-27142, JP-A-56-33644, JP-A-56-149036, JP-B-61-10199, and JP-B-61-52459; using an active carbon disclosed in JP-B-55-1571 and JP-A-58-14831; using an ion-exchange membrance disclosed in JP-A-52-105820 and using an ion-exchange resin disclosed in JP-A-55-144240, JP-A-53-132343, JP-A-57-146249 and JP-A-61-95352.

A development-processed photographic emulsion layer is usually subjected to bleaching. According to the present invention, bleaching can be carried out simultaneously with fixing (bleach-fix). Also included in suitable procedures of the present invention for desilvering are a method in which bleach is followed by bleach-fix, a method of using two bleach-fix baths connected in series, a method in which bleach-fix is preceded by fixing, and a method in which bleach-fix is followed by bleaching. A processing procedure of desilvering of the present invention can be selected from among these methods, but, in a preferred embodiment, a light-sensitive material is subjected to bleaching immediately after color development.

Suitable bleaching agents used in a method of the present invention include a mixture of compounds of polyvalent metals, (e.g., iron (III), cobalt (III), chromium (VI), and copper (II)) and peracids. Typical examples of these bleaching agents are complex salts of iron (III) or cobalt (III) with organic acids (e.g., aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid), citric acid, tartaric acid, and malic acid) and persulfates. From the standpoint of rapidness of processing and environmental pollution prevention, preferred bleaching agents are aminopolycarboxylic acid iron (III) complex salts, e.g., ethylenediaminetetraacetic acid iron (III) complex salts and diethylenetriaminepentaacetic acid iron (III) complex salts, persulfates, and hydrogen peroxide. Aminopolycarboxylic acid iron (III) complex salts are preferrable. A bleach-fix bath containing these aminopolycarboxylic acid iron (III) complex salts according to the present invention preferably has a pH of from about 4.0 to 8. For rapid processing, a lower pH can be used. A pH of from about 4.5 to 6.5 is particularly preferred.

A bleach-fix bath, used with a method of the present invention, can additionally contain a bleach accelerator. Specific examples of useful bleach-fix accelerators include compounds having a mercapto group or a disulfide linkage as described in U.S. Pat. No. 3,893,858, West German Patent 1,290,812, JP-A-53-95630, and Research Disclosure, No. 17129 (July, 1978); thiazolidine derivatives as described in JP-A-50-140129; thiourea derivatives as described in U.S. Pat. No. 3,706,561; iodides as described in JP-A-58-16235; polyoxyethylene compounds as described in West German Patent 2,748,430; polyamine compounds as described in JP-B-45-8836; and a bromide ion. Preferred bleach accelerators are compounds having a mercapto group or a disulfide linkage in view of their high accelerating effects. The compounds described in 3,893,858, West German Patent 1,290,812, and JP-A-53-95630 are particularly preferred. In addition, the compounds described in U.S. Pat. No. 4,552,834 are also preferred. These bleach accelerators can be incorporated into a light-sensitive material. A bleach accelerator is especially effective in bleach-fixing of color light-sensitive material for photographing.

Suitable fixing agents used in method of the present invention include thiosulfates, thiocyanates, thioether compounds, thioureas, and a large amount of iodides, with thiosulfates being generally preferred. In particular, ammonium thiosulfate is the most widely usable. Suitable preservatives for the bleach-fixing bath of the present invention include sulfites, bisulfites, sulfinates, and carbonyl bisulfite adducts, with carbonyl bisulfite adducts being particularly preferred.

Additionally, buffers, fluorescent brightening agents, chelating agents, defoaming agents, anti-fungus agents, etc. can be added to the bleach-fix bath.

According to a method of the present invention, a regenerant can be incorporated into a spent bleach-fix bath (overflow) to obtain a regenerated bleach-fix replenisher for reuse.

Accumulated components (e.g., a silver ion) in a regenerated replenisher can be removed or reduced by a known technique, such as a steel wool method as disclosed in JP-A-48-3624 and U.S. Pat. No. 4,065,313, an electrolysis method as described in JP-B-53-40491 and JP-A-61-232452, and a dilution method as described in JP-B-56-33697.

A regenerated replenisher used in a method of the present invention can a alternatively and preferably be obtained by adding a regenerant without removing or reducing the accumulated components particularly silver ion. A regenerant is added to an overflow for the purpose of, in principle, making up the components consumed by a bleach-fix step.

A regenerant which can be used in a method of the present invention comprises a bleaching agent, a fixing agent, and a preservative which can be of the same types used in a bleach-fix bath and additionally, can comprise a bleach accelerator, a re-halogenating agent, a pH buffer, or other additives. It is preferable a the regenerant to further comprise a small amount of an acid.

An acid which is preferably added to a regenerant can be a organic acid and an inorganic acid, with hydrochloric acid, nitric acid, or acetic acid being preferred in order to obtain expected results according to the present invention. An acid is preferably added in an amount of from about 1 to 30 g per liter of a regenerated replenisher, and more preferably in such an amount that the resulting regenerated replenisher can have a pH between about 4.0 and 6.0.

To make up the spent components, a bleaching agent of the present invention used in a regenerant preferably is present in a range from about 0.1 to 50 g/l, and more preferably from about 1 to 30 g/l, in a regenerated replenisher (overflow). Additionally, a regenerant can further comprise, a fixing agent, preferably in the range from about 2 to 50 g/l and more preferably in the range from about 5 to 30 g/l; a preservative, preferably present in a range from about 5 to 50 g/l, and more preferably from about 10 to 30 g/l.

A regenerant can be added to a spent bleach-fix bath (overflow) pooled into a tank, or other suitable container, when the amount of the overflow reaches a given level in order to prepare a replenisher. The overflow can then be reused a number of times. If necessary, after the elapse of a certain period of time, accumulated components of the overflow can be removed by the above-described known methods.

A suitable rate of replenishment in bleach-fix, used according to a method of the present invention, (i.e., the amount of an overflow) is from about 30 to 500 ml, and preferably from 60 to 250 ml, per $m^2$ of a light-sensitive material.

Because the effects of the present invention become pronounced as the processing is sped up, bleach-fix is preferably performed at a temperature of from about 20° to 50° C., and more preferably from about 30° to 40° C., for a processing time of from about 20 seconds to 3 minutes, and more preferably from about 30 seconds to 1 minute.

According to the method of the present invention in which carbonyl bisulfite addition compounds are used as a regenerant, a deterioration of the image preservability and desilverization property can be protected under the usual regeneration rate of 50 to 70% and an excellent treatment of the developed photographic material with a high regeneration rate of the overflow can be attained.

That is, the method of the present invention is highly desirable in such a system that an amount of accumlated components, such as eluted components from the photographic material and carried over components of the developing agent from the pre-bath, becomes higher, when the regeneration rate becomes higher.

The regeneration rate used herein is defined according to the following equations.

$$\text{Regeneration (\%)} = \frac{\text{An amount of reused overflow}}{\text{An amount of overflow}} \times 100$$

Further, the method of the present invention is advantageously utilized when the regeneration is over 80%, preferably over 90%. In an automatic development machine, the method of the present invention contributes to greatly diminish an amount of the solution to be wasted.

After the silver halide color photographic materials have been subjected to desilvering, the desilvered materials are then subjected to washing and/or stabilization. The amount of washing water to be used in the washing step is selected depending on the characteristics of the light-sensitive materials used (e.g., the kind of photographic material, such as couplers), the end use of light-sensitive materials, the temperature of the washing water, the number of washing tanks (the number of washer), the type of replenishing system (e.g., counter-flow system or direct-flow system), and various other conditions. For example, a suitable ratio between the number of washing tanks and the quantity of water in a multi-stage counter-flow system can be obtained by the method described in *Journal of the Society of Motion Picture and Television Engineers*, Vol. 64, pp. 248–253 (May, 1955).

According to a multi-stage counter-flow system e.g., as described in the above-cited reference, although the requisite amount of water can be greatly reduced, there is a tendency that bacteria grow in the tank as the water retention time is increased, and the suspended bacterial cells adhere to light-sensitive materials, causing problems in the development of the photographic material.

In the present invention, such a problem can be effectively over come by adopting a method of reducing calcium and magnesium ions in the washing water as described in JP-A-62-288838. It is also possible to use bactericides, such as isothiazolone compounds or thiabendazoles described in JP-A-57-8542, chlorine type bactericides, e.g., chlorinated sodium isocyanurate, benzotriazoles, and other bactericides described in Hiroshi Horiguchi, *Bokin bobaizai no kagaku*, Eisei Gijutsukai (ed.), *Biseibutsu no mekkin, sakkin, bobai gijutsu*, and Nippon Bokin Bobai Gakkai (ed.), *Bokin bobaizai jiten*.

Washing water to be used in the washing step of the present invention has a pH between about 4 and 9, and preferably between about 5 and 8. Washing is usually carried out at a water temperature of from about 15° C. to 45° C. for a period of from about 20 seconds to about 10 minutes, and preferably at a temperature of from about 25° C. to 40° C. for about 30 seconds to about 2 minutes, though these times and temperature will vary depending on characteristics of a light-sensitive material used, the end use of a light-sensitive material used, and other factors, described herein.

The above-described washing step can alternatively be added to a replaced by stabilizing step. Any of known methods for stabilization processing, such as the methods described in JP-A-57-8543, JP-A-58-14834, and JP-A-60-220345, the contents of which are herein incorporated by reference, can be utilized.

A washing step can be followed by a stabilization processing step. Examples of stabilizing baths include a stabilizing bath comprising formaldehyde and a surface active agent, which is used as a final bath for processing color light-sensitive materials for photographing. A stabilizing bath of the present invention can further comprise various chelating agents and anti-fungal agents.

An overflow resulting from replenishment of washing water and/or stabilizing solution can be utilized for other processing steps, such as desilvering.

For the purpose of simplification and speeding up of processing, a silver halide color light-sensitive material of the present invention can comprise therein a color developing agent. When such a developing agent is used, it is preferably added in the form of a precursor thereof. Examples of suitable color developing agent precursors, used according to a method of the present invention, include indoaniline compounds described in U.S. Pat. No. 3,342,597; Schiff base type compounds described in U.S.

Pat. No. 3,342,599 and *Research Disclosure,* Nos. 14850 (August 1976) and 15159 (November 1976); aldol compounds described in *Research Disclosure,* No. 13924; metal complexes described in U.S. Pat. No. 3,719,492; and urethane compounds described in JP-A-53-135628.

If desired, silver halide color photographic materials of the present invention can comprise various 1-phenyl-3-pyrazolidone compounds for the purpose of accelerating color development. Typical examples of usable 1-phenyl-3-pyrazolidone compounds are described in JP-A-56-64339, JP-A-57-144547, and JP-A-58-115438.

Each processing solution of the present invention can be used at a temperature of from about 10° to 50° C., and usually from about 33° to 38° C. Higher temperatures can be used to accelerate processing and to shorten the processing time, or lower temperatures can be used to improve image quality or stability of a processing solution.

Photographic layers of light-sensitive material which can be used according to the present invention can have a degree of swelling of from about 2.5 to 4.0, and preferably from about 3.0 to 4.0. The "degree of swelling" in this context means a degree of swelling in a regenerated bleach-fix replenisher and, more specifically, a value obtained by immersing a dry light-sensitive material in a bleach-fix solution having a formulation A shown below and used at a temperature of about 35° C. for 1 minute and calculating the degree of swelling by dividing a total thickness of thus swollen photographic layers by a total dry thickness of the photographic layers.

| Formulation A: | |
|---|---|
| Ammonium (ethylenediaminetetraacetato)iron (III) | 60 g |
| Ammonium thiosulfate (70 w/v %) | 100 ml |
| Sodium sulfite | 20 g |
| Sodium sulfate | 20 g |
| Color developing solution (CP-40 FA P1, produced by Fuji Photo Film Co., Ltd.) | 500 ml |
| Silver chloride | 15 g |
| Water to make | 1000 ml |
| pH (adjusted with glacial acetic acid) | 6.40 |

The color developing solution used in the Formulation A above may be replaced by color developing solution in a tank used in the Example 1 of the present specification.

If the degree of swelling is less than 2.5, such a light-sensitive material suffers from the problems of insufficient desilvering and poor color reproduction and, additionally, image preservability is deteriorated, thus failing to obtain sufficient results according to the present invention. If the degree of swelling is larger than about 4.0, the photographic film is so weak that it easily suffers from abrasion fog or pressure fog and also fails to obtain results as those obtained according to a method of the present invention.

The terminology "photographic layers" as used herein means a laminate of hydrophilic colloidal layers containing at least one light-sensitive silver halide emulsion layer and/or emulsion, through which water is allowed to permeate. A backing layer provided on the support on the side opposite to the light-sensitive layer is not included in the term of "photographic layers". Photographic layers are composed of usually a plurality of layers which participate in photographic image formation and can include, e.g., intermediate layers, filter layers, anti-halation layers, protective layers, etc. as well as silver halide emulsion layers.

Any technique can be used in a method of the present invention for adjusting the degree of swelling of a light-sensitive material to the above-recited range. For example, the degree of swelling can be adjusted by controlling the amount and type of gelatin to be used as a binder in the photographic layers, the amount and kind of a gelatin hardening agent to be used, or drying or aging conditions after coating of photographic layers.

Gelatin can be advantageously used as a binder in photographic layers. In addition to gelatin, also included in usable binders are other hydrophilic colloids, such as gelatin derivatives, graft polymers of gelatin and other high polymers; proteins, e.g., albumin and casein; cellulose derivatives, e.g., hydroxyethyl cellulose, carboxymethyl cellulose, and cellulose sulfate; sugar derivatives, e.g., sodium alginate and starch derivatives; and a wide variety of synthetic hydrophilic high polymers, e.g., polyvinyl alcohol, polyvinyl alcohol hemiacetal, poly-N-vinylpyrrolidone, polyacrylic acid, polymethacrylic acid, polyacrylamide, polyvinylimidazole, polyvinylpyrazole, and copolymers comprising monomers constituting these homopolymers.

Gelatin which can be used includes lime-processed gelatin, acid-processed gelatin, gelatin hydrolysis products, and gelatin enzymatic decomposition products, as well as gelatin devivatives.

Gelatin derivatives include those obtained by reacting gelatin with various compounds, such as acid halides, acid anhydrides, isocyanates, bromoacetic acid, alkanesultones, vinylsulfonamides, maleinimide compounds, polyalkylene oxides, and epoxy compounds. Specific examples of these gelatin derivatives are described in U.S. Pat. Nos. 2,614,928, 3,132,945, 3,186,846, and 3,312,553, British Patents 861,414, 1,033,189, and 1,005,784, and JP-B-42-26845.

Gelatin graft polymers include those obtained by grafting to gelatin a homo- or copolymer of vinyl monomers, e.g., acrylic acid, methacrylic acid, a derivative (e.g., ester and amide) of acrylic acid or methacrylic acid, acrylonitrile, and styrene. Preferred of these polymers are graft polymers of gelatin and polymers having compatibility with gelatin to some extent, e.g., polymers of acrylic acid, methacrylic acid, acrylamide, methacrylamide, and a hydroxyalkyl methacrylate. Specific examples of the gelatin graft polymers are described in U.S. Pat. Nos. 2,763,625, 2,831,767, and 2,956,884.

Typical examples of synthetic hydrophilic high polymers are described in West German Patent Application (OLS) No. 2,312,708, U.S. Pat. Nos. 3,620,751 and 3,879,205, and JP-B-43-7561.

Hardening agents which can be used in the present invention include chromates (e.g., chromium alum, chromium acetate), aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds (e.g., 1,3,5-triacryloyl-hexahydro-s-triazine, bis(vinylsulfonyl)methyl ether, N,N,-methylenebis[β-(vinylsulfonyl)propionamide]), active halogen compounds (e.g., 2,4-dichloro-6-hydroxy-s-triazine), mucohalogenic acids (e.g., mucochloric acid, mucophenoxychloric acid), isoxazoles, dialdehyde starch, and 2-chloro-6-hydroxytriazinylated gelatin. These hardening agents may be used either individually or in combination thereof. Specific examples of useful hardening agents are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644, and 3,543,292, British Patents 676,628, 825,544, and 1,270,578, West German Patents 872,153 and 1,090,427, and JP-B-34-7133 and JP-B-46-1872. Preferred of them are aldehydes, active vinyl compounds, and active halogen compounds.

A light-sensitive material which can be used according to a method of the present invention preferably has a total silver coverage of not more than about 0.80 $g/m^2$. A preferred silver coverage is from about 0.40 to 0.70 $g/m^2$, more preferably about 0.40 to 0.65 $g/m^2$. More preferably, a silver coverage in each of at least three light-sensitive layers differing in color sensitivity (e.g., a blue-sensitive layer, a green-sensitive layer, and a red-sensitive layer) can range from about 0.1 to 0.3 $g/m^2$.

If the total silver coverage exceeds about 0.80 $g/m^2$, desilvering properties, color reproducibility, and image preservability are all deteriorated. In particular, when a color photographic material having 2.5 to 4.0 of degree of swelling and not more than 0.8 $g/m^2$, preferably 0.4 to 0.70 $g/m^2$ of silver coverage, desilvering properties, color reproducibility, and image preservability can be remarkably improved.

The processing method according to the present invention is applicable to any type of processing as long as a color developing solution is used. For example, it is applicable to processing, for example, of color paper, color reversal paper, color positive films, color negative films, color reversal films, color direct positive light-sensitive materials, etc. Application to color paper, color reversal paper, and auto-positive paper is suitable.

In silver halide color photographic materials according to the present invention, silver halide emulsions can have any halogen composition, such as, e.g., silver iodobromide, silver bromide, silver chlorobromide, and silver chloride.

Where rapid processing or low-replenishment processing is used, a silver chlorobromide or silver chloride emulsion having a silver chloride content of at least about 60 mol %, particularly from about 80 to 100 mol % (i.e., silver chloride emulsion), is preferred. Where a high photographic speed is needed while requiring reduction of fog during preparation, preservation and/or processing of a light-sensitive material, a silver bromide emulsion or a silver chlorobromide emulsion of the present invention having a silver bromide content of at least about 50 mol %, and particularly at least about 70 mol %, is preferably used. If a silver bromide content exceeds about 90 mol %, rapid processing is difficult. However, using for accelerated development, for example, a silver halide solvent, on a fogging agent, or a development accelerator, can be used to increase the rate of development to some extent irrespective of the silver bromide content. Thus, silver halide emulsions having a silver bromide content exceeding about 90 mol % are sometimes preferred. In any case, a high silver iodide content is unfavorable and is preferably not more than about 3 mol %. An effect of the processing of the present invention under high regeneration rate is remarkably improved in desilvering defects and cyan discoloration defects which are caused when a high silver chloride emulsion is used. These effects are particularly enhanced when a content of silver chloride is 90 to 100 mol %, more preferably 95 to 100 mol %. The effect is further remarkable comparing with those obtained in the prior known silver chlorobromide emulsion under higher regeneration. These silver halide emulsions are preferably used chiefly in light-sensitive materials for printing, such as color paper.

For color light-sensitive materials used for photographing, such as negative films and reversal films, silver iodobromide or silver chloroiodobromide emulsions of the present invention preferably have a silver iodide content of from about 3 to 15 mol %.

Silver halide grains which can be used in the present invention can have a heterogeneous structure different between the inner and the outer layer (core/shell grains), a multi-phase structure having an epitaxially fused structure, a homogeneous structure, or a mixed structure thereof.

A mean grain size of silver halide grains used according to a method of the present invention is preferably from about 0.1 to 2 μm, and more preferably from about 0.15 to 1.5 μm. The terminology "mean grain size" as used herein means an average of a diameter of spherical or nearly spherical grains or a side length of cubic grains, calculated based on a projected area. A mean grain size of tabular grains is calculated from a sphere-equivalent diameter. Grain size distribution may be either narrow or broad. In particular, a so-called mono-dispersed emulsion whose grain size variation coefficient (a quotient obtained by dividing a standard deviation of a size distribution curve by the mean grain size) falls within about 20%, and particularly within about 15%, is preferred.

To meet a desired gradation, two or more mono-dispersed silver halide emulsions differing in grain size, whose coefficient of variation is preferably within the above-recited range, may be incorporated into the same emulsion layer or separate layers having substantially the same color sensitivity. Further, a combination of two or more poly-dispersed emulsions or a combination of a mono-dispersed emulsion and a poly-dispersed emulsion may be used as a mixture thereof in the same layer or separately incorporated in different layers.

Silver halide grains to be used are not limited in shape and may have a regular crystal form, such as a cubic form, an octahedral form, a rhombic dodecahedral form, and a tetradecahedral form, or a mixture thereof; or an irregular crystal form, such as a spherical form; or a composite form thereof. An emulsion comprising tabular grains, particularly an emulsion in which at least about 50% of the total grains based on the total projected area comprise tabular grains having an aspect ratio of about 5 or more, and preferably about 8 or more, can be used as well. Emulsions comprising a mixture of these various crystal forms may also be used. These emulsions may be either of a surface latent image type which forms a latent image predominantly on the grain surface or of a internal latent image type which forms a latent image predominantly in the inside of grains.

Photographic emulsions that can be used according to a method the present invention can be prepared by a process, e.g., such as is described in *Research Disclosure*, Vol. 176, Item No. 17643 (I, II, III) (December, 1978). Emulsions are generally subjected to physical ripening, chemical ripening, and spectral sensitization before use. Photographic additives which can be used in these steps are described in *Research Disclosure* (RD), Vol. 176, No. 17643 (December, 1978) and ibid, Vol. 187, No. 18716 (Nov., 1979) as listed below.

Other photographic additives which can be used in the present invention are also described in the above-cited references as listed below.

| Additive | RD 17643 | RD 18716 |
|---|---|---|
| 1. Chemical Sensitizer | p. 23 | p. 648, right column (RC) |
| 2. Sensitivity Increasing Agent | p. 23 | p. 648, right column (RC) |
| 3. Spectral Sensitizer, | pp. 23–24 p. 649, RC | p. 648, RC to |
| 4. Supersensitizer | pp. 23–24 p. 649, RC | |
| 5. Brightening Agent | p. 24 | |
| 6. Antifoggant and Stabilizer | pp. 24–25 | p. 649, RC |
| 7. Coupler | p. 25 | p. 649, RC |
| 8. Organic Solvent | p. 25 | p. 649, RC |
| 9. Light Absorber, Filter Dye | pp. 25–26 | p. 649, RC to p. 650, left column (LC) |
| 10. Ultraviolet Absorber | pp. 25–26 | p. 649, RC to p. 650, left column (LC) |
| 11. Stain Inhibitor | p. 25, RC | p. 650, LC to RC |
| 12. Dye Image Stabilizer | p. 25 | p. 650, LC to RC |
| 13. Hardening Agent | p. 26 | p. 651, LC |
| 14. Binder | p. 26 | p. 651, LC |
| 15. Plasticizer, Lubricant | p. 27 | p. 650, RC |
| 16. Coating Aid, Surface Active Agent | pp. 26–27 | p. 650, RC |
| 17. Antistatic Agent | p. 27 | p. 650, RC |

Various color couplers can also be used in the present invention. The teriminology "color couplers" as used herein means compounds capable of undergoing coupling reaction with an oxidation product of an aromatic primary amine developing agent to form a dye. Typical examples of useful color couplers include naphthol or phenol compounds, pyrazolone or pyrazoloazole compounds, and open-chain or heterocyclic ketomethylene compounds. Specific examples of these cyan, magenta, and yellow couplers which can be used in this invention are described in patents cited in *Research Disclosure,* No. 17632, VII-D (December, 1978).

Color couplers which are incorporated into a light-sensitive material that can be used in a method of the present invention preferably have a ballast group or have a polymeric form and are thereby nondiffusive. From the standpoint of conservation of silver, 2-equivalent couplers having the coupling position thereof substituted with a group releasable on coupling are preferable to 4-equivalent couplers whose coupling position is a hydrogen atom. In addition, couplers producing a dye having moderate diffusibility, colorless couplers, DIR couplers capable of releasing a development inhibitor on coupling, or couplers capable of releasing a development accelerator on coupling can also be used.

Suitable yellow couplers which can be used in the present invention typically includes oil-protected type acylacetamide couplers. Specific examples of these couplers are given in U.S. Pat. Nos. 2,407,210, 2,875,507, and 3,265,506. Two-equivalent yellow couplers are preferred as above. Included in these dyes are yellow couplers of oxygen-release type as described in U.S. Pat. Nos. 3,408,194, 3,447,928, 3,933,501, and 4,022,620; and nitrogen-release type yellow couplers as described in JP-B-58-10739, U.S. Pat. Nos. 4,401,752 and 4,326,024, *Research Disclosure* 18053 (April, 1979), British Patent 1,425,020, and West German Patent OLS Nos. 2,219,917, 2,261,361, 2,329,587, and 2,433,812. In particular, α-pivaloylacetanilide couplers produce dyes having excellent fastness, especially to light, and α-benzoylacetanilide couplers produce dyes having high color density.

Suitable magenta couplers which can be used according to the present invention include oil-protected type indazolone or cyanoacetyl couplers, preferably 5-pyrazolone couplers and pyrazoloazole couplers such as pyrazolotriazoles. The 5-pyrazolone couplers preferably have the 3-position thereof substituted with an arylamino group or an acylamino group in view of the hue or density of a developed color. Typical examples of such 5-pyrazolone couplers are described in U.S. Pat. Nos. 2,311,082, 2,343,703, 2,600,788, 2,908,573, 3,062,653, 3,152,896, and 3,936,015. Releasable groups of the 2-equivalent 5-pyrazolone couplers preferably include nitrogen-releasable groups as described in U.S. Pat. No. 4,310,619 and arylthio groups as described in U.S. Pat. No. 4,351,897. Further, 5-pyrazolone couplers having a ballast group as described in European Patent 73,636 produce high color densities.

Suitable pyrazoloazole couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure,* 24220 (June, 1984), and pyrazolopyrazoles as described in *Research Disclosure,* 24230 (June, 1984). From the standpoint of reduction in undesired yellow absorption and light fastness of a developed color, imidazo[1,2-b]pyrazoles as described in European Patent 119,741 are preferred, and pyrazolo[1,5-b][1,2,4]triazole described in European Patent 119,860 is particularly preferred.

Cyan couplers which can be used in a method of the present invention include oil-protected type naphthol and phenol couplers. Typical examples of these cyan couplers are naphthol couplers described in U.S. Pat. No. 2,474,293, and preferably oxygen-release type 2-equivalent naphthol couplers as described in U.S. Pat. Nos. 4,052,212, 4,146,396, 4,228,233, and 4,296,200. Examples of phenol couplers are described in U.S. Pat. Nos. 2,369,929, 2,801,171, 2,772,162, and 2,895,826. Cyan couplers stable to moisture and heat are preferably used in the present invention. Typical examples of such couplers include phenol cyan couplers having an alkyl group having at least two carbon atoms at the m-position of the phenol nucleus as described in U.S. Pat. No. 3,772,002, 2,5-diacylamino-substituted phenol couplers as described in U.S. Pat. Nos. 2,772,162, 3,758,308, 4,126,396, 4,334,011, and 4,327,173, West German Patent OLS No. 3,329,729, and JP-A-59-166956, and phenol couplers having a phenylureido group at the 2-position and an acylamino group at the 5-position as described in U.S. Pat. Nos. 3,446,622, 4,333,999, 4,451,559, and 4,427,767.

It has been proved that the beneficial effects of the present invention are particularly pronounced when using a light-sensitive material containing a cyan coupler represented by formula (I):

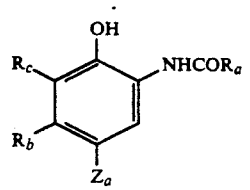

(I)

wherein $R_a$ represents an alkyl group, a cycloalkyl group, an aryl group, an amino group, or a heterocyclic group; $R_b$ represents an acylamino group or an alkyl group having 2 or more carbon atoms; $R_c$ represents a hydrogen atom, a halogen atom, an alkyl group, or an alkoxy group; $R_c$ and $R_b$ may be taken together to form a ring; and $Z_a$ represents a hydrogen atom, a halogen atom, or a group releasable on reacting with an oxidation product of an aromatic primary amine color developing agent (hereinafter referred to as coupling-releasable group).

Use of the cyan coupler of formula (I) brings about marked effects on thermal discoloration of a cyan dye formed in the regeneration system of the present invention. That is, even when the overflow contains relatively large amount of elute component and a component in the pre-bath, the method of the present invention performs with unexpected excellent advantages. The cyan coupler represented by formula (c) below is advantageously used in the case where the regeneration rate is over 80%, preferably over 90%.

In formula (I), the alkyl group represented by $R_a$ preferably includes those having from 1 to 32 carbon atoms, e.g., methyl, butyl, tridecyl, cyclohexyl, and allyl groups. The aryl group represented by Ra includes phenyl and naphthyl groups. The heterocyclic group represented by $R_a$ includes 2-pyridyl and 2-furyl groups. The amino group represented by $R_a$ preferably includes substituted or unsubstituted phenylamino groups.

These substituent groups represented by $R_a$ may have a substituent selected from an alkyl group, an aryl group, an alkyl- or aryloxy group (e.g., methoxy, dodecyloxy, methoxyethoxy, phenyloxy, 2,4-di-t-amylphenoxy, 3-t-butyl-4-hydroxyphenyloxy, naphthyloxy), a carboxyl group, an alkyl- or arylcarbonyl group (e.g., acetyl, tetradecanoyl, benzoyl), an alkyl- or aryloxycarbonyl group (e.g., methoxycarbonyl, phenoxycarbonyl), an acyloxy group (e.g., acetyl, benzoyloxy), a sulfamoyl group (e.g., N-ethylsulfamoyl, N-octadecylsulfamoyl), a carbamoyl group (e.g., N-ethylcarbamoyl, N-methyl-dodecylcarbamoyl), a sulfonamido group (e.g., methanesulfonamido, benzenesulfonamido), an acylamino group (e.g., acetylamino, benzamido, ethoxycarbonylamino, phenylaminocarbonylamino), an imido group (e.g., m succinimido, hydantoinyl), a sulfonyl group (e.g., methanesulfonyl), a hydroxyl group, a cyano group, a nitro group, and a halogen atom.

In formula (c), Rb represents, as an acylamino group, for example, a dichloroacetyl and a heptafluorobutylylamino group; as an alkyl group having 2 or more carbon atoms, an ethyl, propyl, butyl, pentadecyl, tertbutyl, phenylthioethyl, and methoxyethyl group; and preferably is an alkyl group having 2 to 15 carbon atoms, most preferably alkyl group having 2 to 4 carbon atoms.

Further, in formula (c), Rc represents as a halogen atom, form example, a chlorine, bromine, and fluorine atom; as alkyl group, a methyl, ethyl, propyl, butyl, pentadecyl, tertbutyl, cychlohexylmethyl, phenylthiomethyl, dodecyloxyphenylthiomethyl, butaneamidomethyl, and methoxymethyl; and, as an alkoxyl group, an ethoxy, dodecyloxy, methoxyethylcarbamoylmethoxy, 3-(methane sulfoneamide)propyloxy, carboxypropyloxy, and methylsulfonylethoxy group; and preferably is a hydrogen and halogen atom, most preferably a chlorine and fluorine atom.

In formula (I), $Z_a$ represents a hydrogen atom or a coupling-releasable group. Examples of the coupling-releasable group include a halogen atom (e.g., fluorine, chlorine, bromine), an alkoxy group (e.g., dodecyloxy, methoxycarbamoylmethoxy, carboxypropyloxy, methylsulfonylethoxy), an aryloxy group (e.g., 4-chlorophenoxy, 4-methoxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, methanesulfonylamino, toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an aliphatic or aromatic thio group (e.g., phenylthio, tetrazolylthio), an imido group (e.g., succinimido, hydantoinyl), a nitrogen-containing heterocyclic group (e.g., 1-pyrazoly, 1-benzotriazolyl), and an aromatic azo group (e.g., phenylazo). These releasable groups can contain a photographically useful group.

The compound represented by formula (I) can have a form of a polymer, inclusive of a dimer, formed at $R_a$ or $R_b$.

Specific but non-limiting examples of the cyan couplers of formula (I) are shown below.

(C-1)

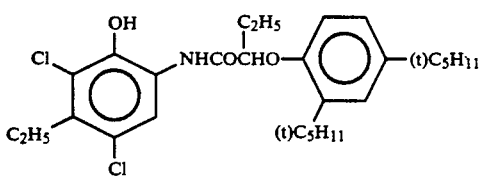

(C-2)

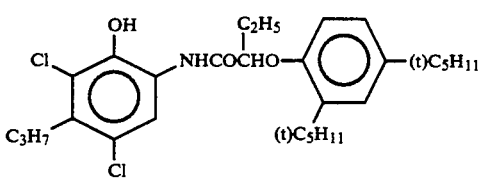

(C-3)

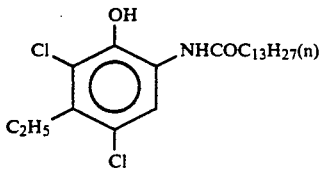

(C-4)

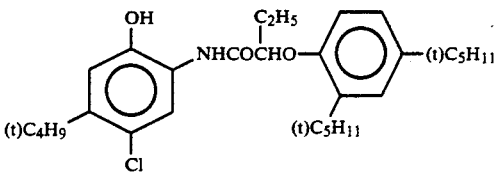

-continued
(C-5)
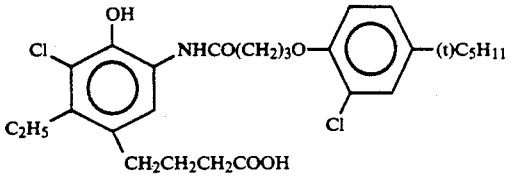
(C-6)
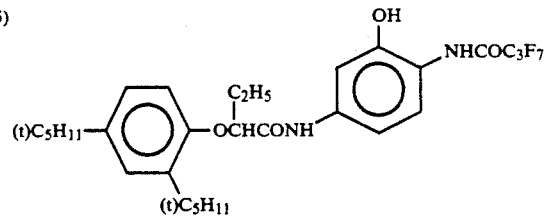
(C-7)
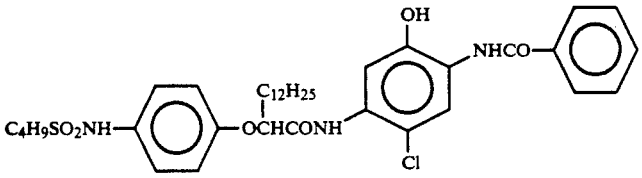
(C-8)
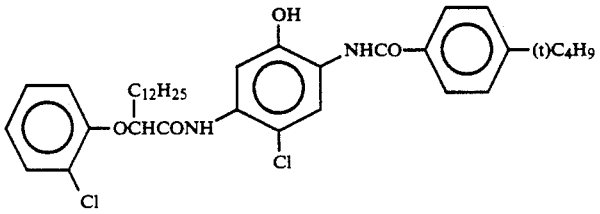
(C-9)
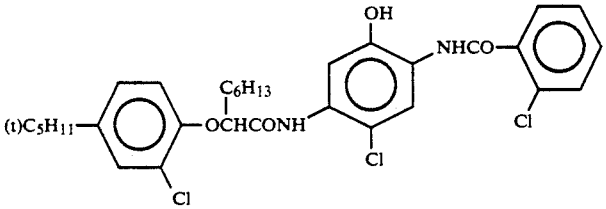
(C-10)
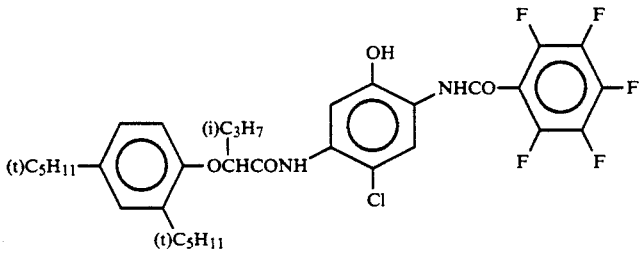
(C-11)
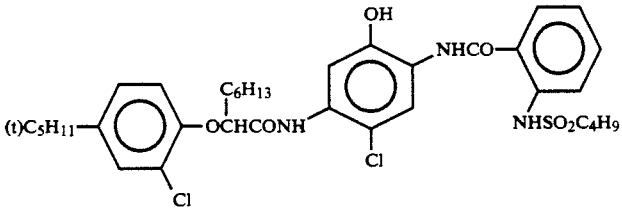
(C-12)
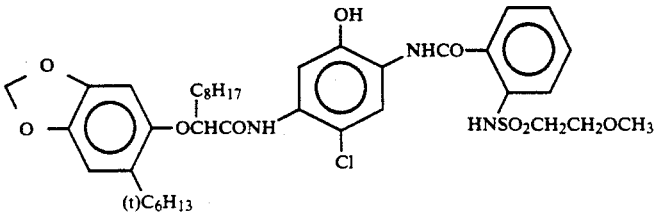

-continued
(C-13)
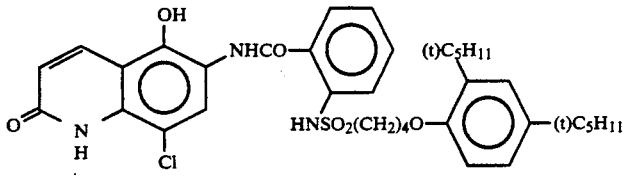
(C-14)
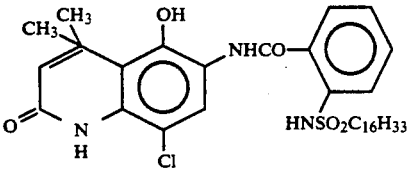
(C-15)
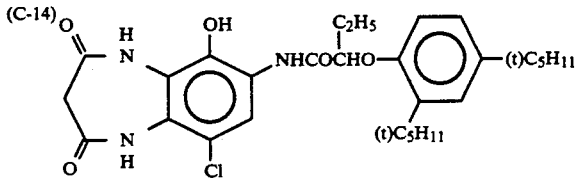
(C-16)
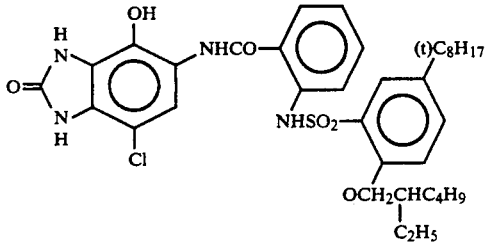
(C-17)
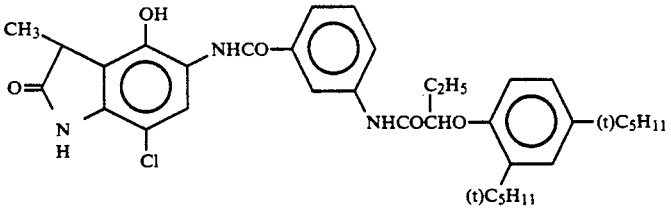
(C-18)
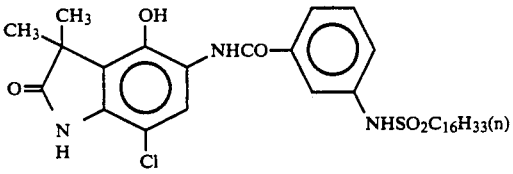
(C-19)
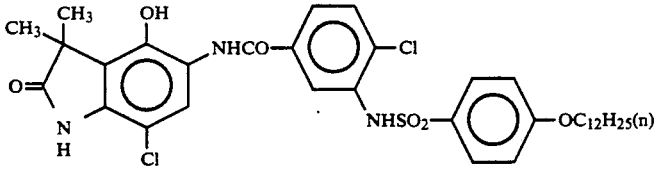
(C-20)
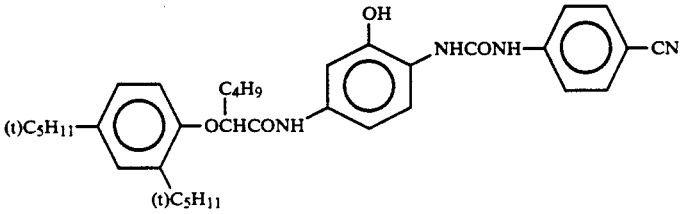

-continued
(C-21)
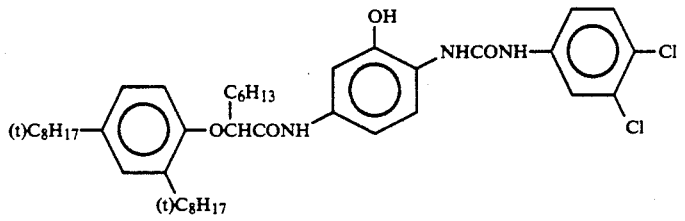
(C-22)
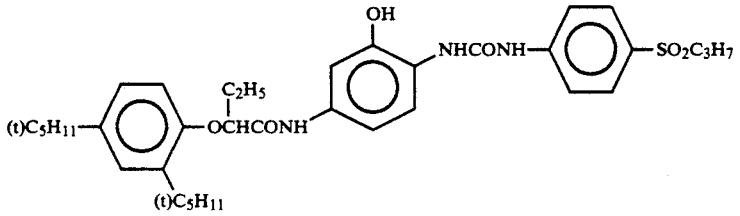
(C-23)
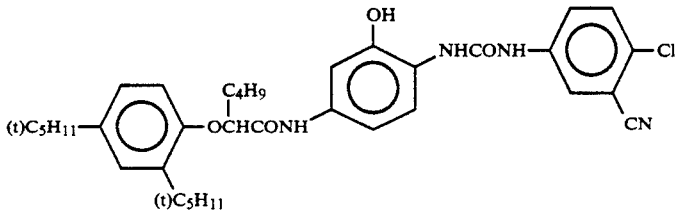
(C-24)
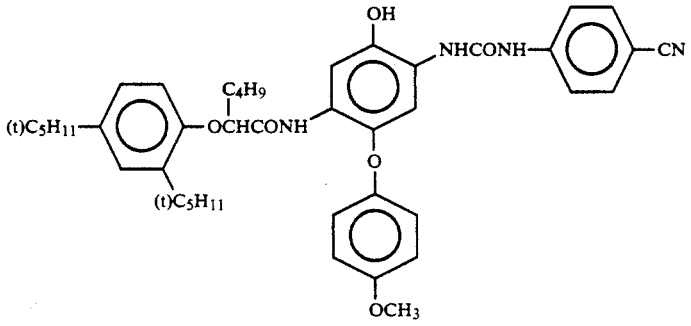
(C-25)
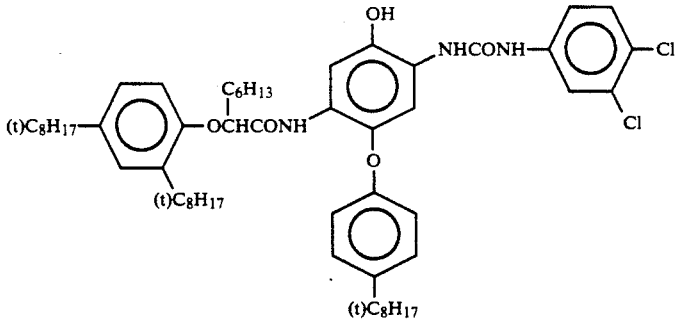
(C-26)
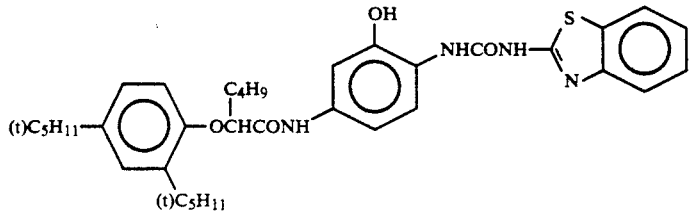

The cyan couplers of formula (I) can be synthesized according to, for example, the disclosure of JP-A-59-166956 and JP-B-49-11572.

The amount of the above-described cyan coupler is not particularly limited, but preferably ranges from about $1\times10^{-4}$ to $1\times10^{-2}$ mol, and more preferably from about $1\times10^{-5}$ to $1\times10^{-3}$ mol, per $m^2$ of a light-sensitive material.

The combined use of a coupler which produces a dye having moderate diffusibility improves graininess. Examples of such a coupler include magenta couplers described in U.S. Pat. No. 4,366,237 and British Patent 2,125,570 and yellow, magenta or cyan couplers described in European Patent 96,570 and West German Patent OLS No. 3,234,533.

Dye-forming couplers and special couplers as stated above may be in the form of a polymer, inclusive of a dimer. Typical examples of dye-forming couplers in a polymer form are illustrated in U.S. Pat. Nos. 3,451,820 and 4,080,211. Magenta couplers in a polymer form are described in British Patent 2,102,173 and U.S. Pat. No. 4,367,282.

For the purpose of satisfying various characteristics required for light-sensitive materials, the above-described various couplers can be used, in a method of the present invention, as a mixture of two or more thereof in one light-sensitive layer or each of them can be introduced into two or more light-sensitive layers.

The couplers can be introduced into a light-sensitive material by various known dispersion techniques. Examples of high-boiling organic solvents which can be used in an oil-in-water dispersion method are described, e.g., in U.S. Pat. No. 2,322,027. Steps, effects, and specific examples of impregnating latices with respect to a latex dispersion method, one of polymer dispersion techniques, are described, e.g., in U.S. Pat. No. 4,199,363 and West German Patent Application OLS Nos. 2,541,274 and 2,541,230. A dispersion method using an organic solvent-soluble polymer is described, e.g., in PCT Application No. JP87/00492.

Examples of organic solvents which can be used in the above-mentioned oil-in-water dispersion method include alky phthalates (e.g., dibutyl phthalate, dioctyl phthalate), phosphoric esters (e.g., diphenyl phosphate, triphenyl phosphate, tricresyl phosphate, dioctylbutyl phosphate), citric esters (e.g., acetyl tributyl citrate), benzoic esters (e.g., octyl benzoate), alkylamides (e.g., diethyllaurylamide), fatty acid esters (e.g., dibutoxyethyl succinate, diethyl azelate), and trimesic esters (e.g., tributyl trimesate). Organic solvents having a boiling point of from 30° to 150° C., such as a lower alkyl acetate (e.g., ethyl acetate, butyl acetate), ethyl propionate, sec-butyl alcohol, methyl isobutyl ketone, β-ethoxyethyl acetate, and methyl cellosolve, may be used in combination.

Standard amounts of color couplers to be used in a method of the present invention range from about 0.001 to 1 mol per mol of light-sensitive silver halide. In more detail, yellow couplers are used in an amount of from about 0.01 to 0.5 mol; magenta couplers are used in an amount of from about 0.003 to 0.3 mol; and cyan couplers are used in an amount of from about 0.002 to 0.3 mol, each per mol of light-sensitive silver halide.

Finished emulsions or other coating compositions are coated on an appropriate support commonly employed in the art, including a flexible support, e.g., a film of synthetic resins (e.g., cellulose nitrate, cellulose acetate, polyethylene terephthalate) and paper, and a rigid support, e.g., a glass sheet. With respect to usable supports and coating methods, suitable Examples are described, e.g., in *Research Disclosure,* Vol. 176, Item 17643 XV (p. 27), XVIII (p. 28) (December, 1978).

According to a method of the present invention, a reflective support can be used advantageously. The terminology "reflective support" means a support having increased reflection properties to make a dye image formed in silver halide emulsion layers clearer. Included in such a reflective support of the present invention are a support coated with a hydrophobic resin having dispersed therein a light-reflecting substance, e.g., titanium oxide, zinc oxide, calcium carbonate, and calcium sulfate, and a support comprising a hydrophobic resin having dispersed therein the above-mentioned light-reflecting substance.

The present invention is now illustrated in greater detail by way of Examples, but it should be understood that the present invention is not construed as being limited thereto. All the percents are given by weight unless otherwise indicated.

EXAMPLE 1

Layers shown below were coated on a polyethylene-laminated (on both sides) paper support in the order listed to prepare a multi-layer color paper. Coating compositions were prepared as follows.

Preparation of 1st Layer Coating Composition

To a mixture of 19.1 g of a yellow coupler (ExY), 4.4 g of a dye image stabilizer (Cpd-1), and 0.7 g of a dye image stabilizer (Cpd-7) were added 27.2 ml of ethyl acetate and 8.2 g of a solvent (Solv-1) to form a solution. The resulting solution was emulsified and dispersed in 185 ml of a 10% gelatin aqueous solution containing 8 ml of 10% sodium dodecylbenzenesulfonate.

Separately, a cubic silver chlorobromide emulsion having a mean grain size of 0.88 μm and a variation coefficient of size distribution of 0.08 (hereinafter referred to as larger size emulsion) and a cubic silver chlorobromide emulsion having a mean grain size of 0.70 μm and a variation coefficient of 0.10 (hereinafter referred to as smaller size emulsion), both of which locally contained 0.2 mol % of silver bromide on the grain surface, were mixed at an Ag ion molar ratio of 3:7. Each of blue-sensitive sensitizing dyes shown below was added to a larger size emulsion in an amount of $2.0\times10^{-4}$ mol/mol-Ag and to a smaller size emulsion in an amount of $2.5\times10^{-4}$ mol/mol-Ag. The emulsion was then subjected to sulfur sensitization.

The above-prepared coupler dispersion and the finished emulsion were mixed to prepare a first layer coating composition having a formulation shown below.

Coating compositions for second to seventh layers were also prepared in the same manner as for the 1st layer coating composition.

To each coating composition, 2,4-dichloro-6-hydroxy-s-triazine sodium salt was added as a gelatin hardening agent.

The amount of the gelatin hardening agent to be used in each layer was varied so that the resulting photographic layers might have a degree of swelling shown in Table 1 below. The thus prepared samples were designated Samples 1A to 1F.

TABLE 1

| Sample No. | Degree of Swelling* |
|---|---|
| 1A | 2.0 |
| 1B | 2.5 |
| 1C | 3.0 |
| 1D | 3.5 |
| 1E | 4.0 |

Note:
*as defined above.

Spectral sensitizing dyes used in each light-sensitive layer and their amounts are shown below.

Blue-Sensitive Layer:

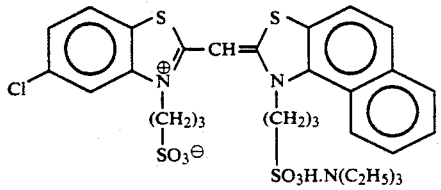

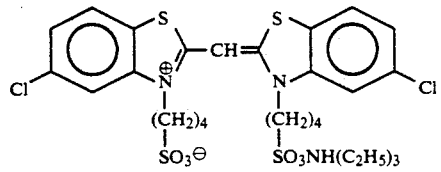

$2.0\times10^{-4}$ mol/mol-AgX (X: halogen) in larger size emulsion
$2.5\times10^{-4}$ mol/mol-AgX in smaller size emulsion

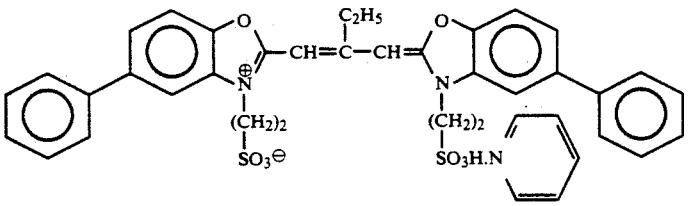

$4.0\times10^{-4}$ mol/mol-AgX in larger size emulsion
$5.6\times10^{-4}$ mol/mol-AgX in smaller size emulsion

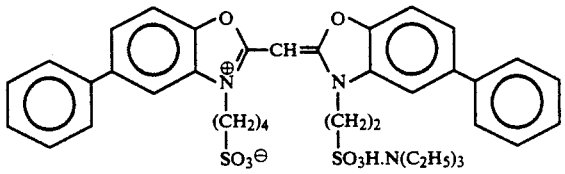

$7.0\times10^{-5}$ mol/mol-AgX in larger size emulsion
$1.0\times10^{-5}$ mol/mol-AgX in smaller size emulsion

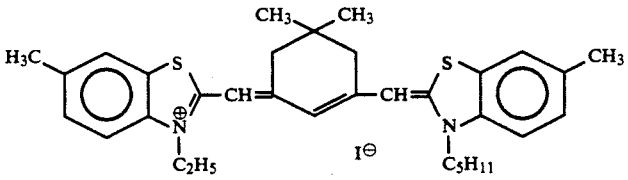

$0.9\times10^{-4}$ mol/mol-AgX in larger size emulsion
$1.1\times10^{-4}$ mol/mol-AgX in smaller size emulsion To the coating composition for a red-sensitive emulsion layer was added a compound shown below in an amount of $2.6\times10^{-3}$ mol/mol-AgX.

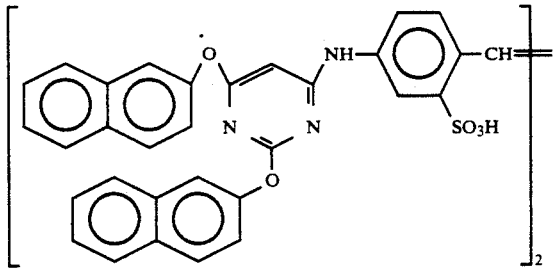

To each of the coating compositions for blue-, green- and red-sensitive emulsion layers was added 1-(5-methylureidophenyl)-5-mercaptotetrazole in an amount of $8.5\times10^{-5}$ mol, $7.7\times10^{-4}$ mol, and $2.5\times10^{-4}$ mol, respectively, per mol of AgX.

To each of the coating compositions for blue- and green-sensitive emulsion layers was added 4-hydroxy-6-methyl-1,3,3a,7-tetraazaindene in an amount of $1\times10^{-4}$ mol and $2\times10^{-4}$ mol, respectively, per mol of AgX.

For the purpose of preventing irradiation, the following dyes were added to the emulsion layers.

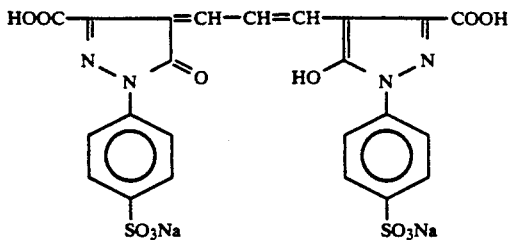

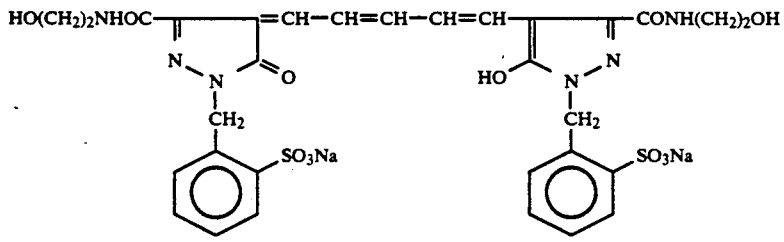

The layer structure of the multi-layer color paper is shown below. The amount of a silver halide emulsion is reduced to silver coverage (g/m$^2$).

Layer Structure

Support

Polyethylene-laminated paper, the polyethylene layer on the size to be coated with a 1st layer contained a white pigment ($TiO_2$) and a bluing dye (ultramarine).

| | Amount (g/m$^2$) |
|---|---|
| First Layer (Blue-Sensitive Layer): | |
| The above-described silver chlorobromide emulsion | 0.30 |
| Gelatin | 1.86 |
| Yellow coupler (ExY) | 0.82 |
| Dye image stabilizer (Cpd-1) | 0.19 |
| Solvent (Solv-1) | 0.35 |
| Dye image stabilizer (Cpd-7) | 0.06 |
| Second Layer (Color Mixing Preventive Laver): | |
| Gelatin | 0.99 |
| Color mixing inhibitor (Cpd-5) | 0.08 |
| Solvent (Solv-1) | 0.16 |
| Solvent (Solv-4) | 0.08 |
| Third Layer (Green-Sensitive Layer): | |
| Silver chlorobromide emulsion (cubic grains; a 1:3 (by Ag mol) mixture of an emulsion having a mean grain size of 0.55 μm and a size variation coefficient of 0.10 and an emulsion having a mean grain size of 0.39 μm and a size variation coefficient of 0.08, both emulsions locally containing 0.8 mol % of AgBr on part of the grain surface) | 0.12 |
| Gelatin | 1.24 |
| Magenta coupler (ExM) | 0.20 |
| Dye image stabilizer (Cpd-2) | 0.03 |

-continued

| | Amount (g/m$^2$) |
|---|---|
| Dye image stabilizer (Cpd-3) | 0.15 |
| Dye image stabilizer (Cpd-4) | 0.02 |
| Dye image stabilizer (Cpd-9) | 0.02 |
| Solvent (Solv-2) | 0.40 |
| Fourth Layer (Ultraviolet Absorbing Layer): | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| Fifth Layer (Red-Sensitive Layer): | |
| Silver chlorobromide emulsion (cubic grains; a 1:4 (by Ag mol) mixture of an emulsion having a mean grain size of 0.58 μm and a size variation coefficient of 0.09 and an emulsion having a mean grain size of 0.45 μm and a size variation coefficient of 0.11, both emulsions locally containing 0.6 mol % of AgBr on part of the grain surface) | 0.23 |
| Gelatin | 1.34 |
| Cyan coupler (ExC) | 0.32 |
| Dye image stabilizer (Cpd-6) | 0.17 |
| Dye image stabilizer (Cpd-7) | 0.40 |
| Dye image stabilizer (Cpd-8) | 0.04 |
| Solvent (Solv-6) | 0.15 |
| Sixth Layer (Ultraviolet Absorbing Layer): | |
| Gelatin | 0.53 |
| Ultraviolet absorbent (UV-1) | 0.16 |
| Color mixing inhibitor (Cpd-5) | 0.02 |
| Solvent (Solv-5) | 0.08 |
| Seventh Layer (Protective Layer): | |
| Gelatin | 1.33 |
| Acryl-modified copolymer of polyvinyl alcohol (degree of modification: 17%) and melecular weight: | 0.17 |
| | 80,000 |
| Liquid paraffin | 0.03 |

Couplers and other photographic additives used above are shown below.

Yellow Coupler (ExY):

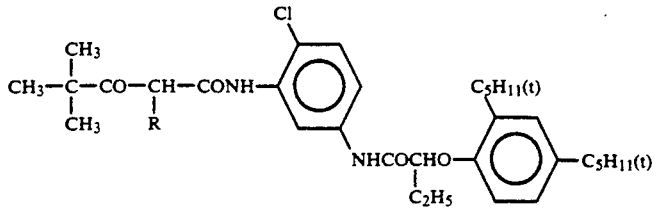

-continued
(wherein R: 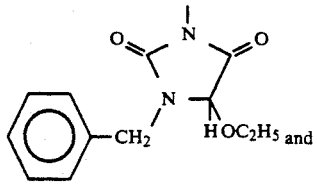 and
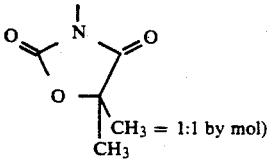
Magenta Coupler (ExM):
1:1 (by mol) mixture of:
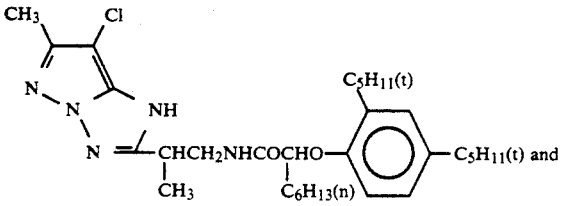
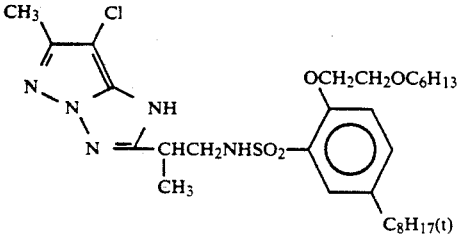
Cyan Coupler (ExC):
2:4:4 (by weight) mixture of:
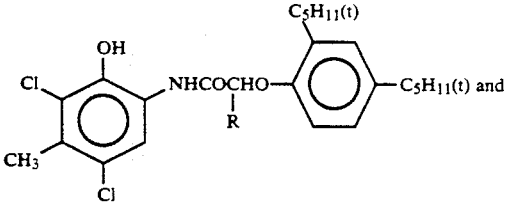
(wherein R: $C_2H_5$ and $C_4H_9$)
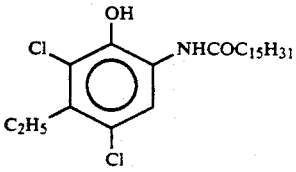
Dye Image Stabilizer (Cpd-1):
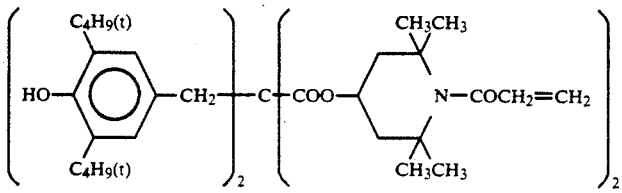
Dye Image Stabilizer (Cpd-2):

-continued
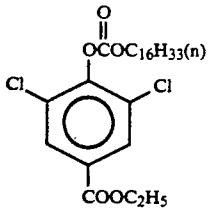
Dye Image Stabilizer (Cpd-3):
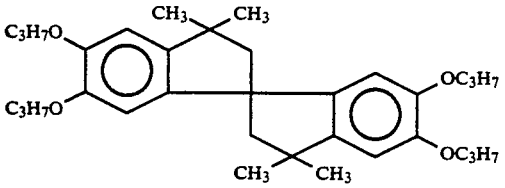
Dye Image Stabilizer (Cpd-4):
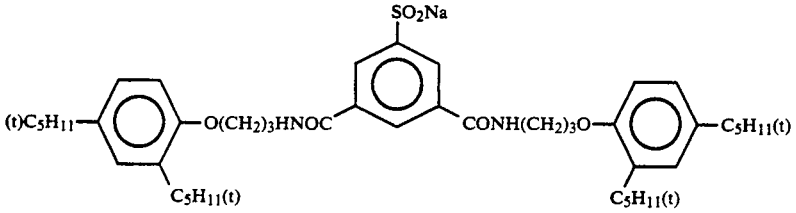
Color Mixing Inhibitor (Cpd-5):
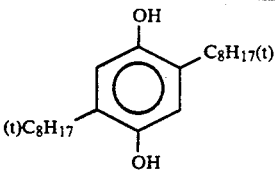
Dye Image Stabilizer (Cpd-6):
2:4:4 (by weight) mixture of:
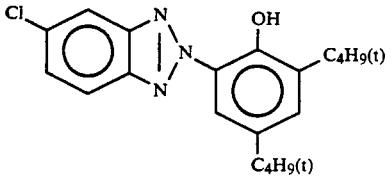
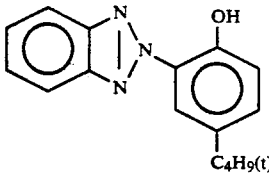
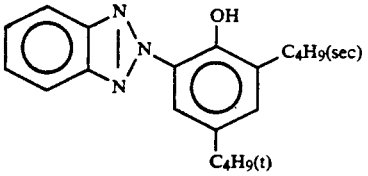
Dye Image Stabilizer (Cpd-7):
$$\left(CH_2-\underset{\substack{|\\ CONHC_4H_9(t)}}{CH}\right)_n$$
(Average Molecular Weight: 60,000)
Dye Image Stabilizer (Cpd-8):

-continued
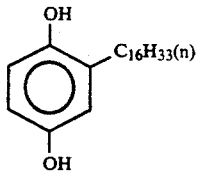
Dye Image Stabilizer (Cpd-9):
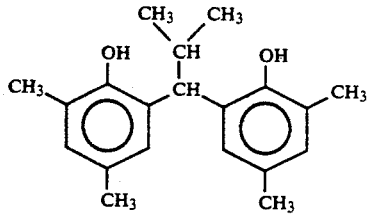
Ultraviolet Absorbent (UV-1):
4:2:4 (by weight) mixture of:
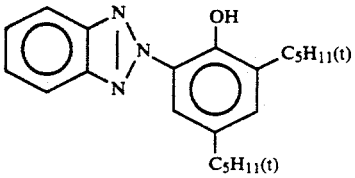
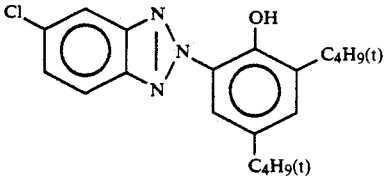
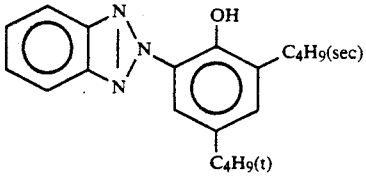
Solvent (Solv-1):
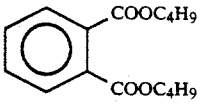
Solvent (Solv-2):
2:1 (by volume) mixture of:
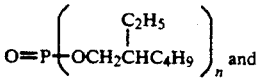
and
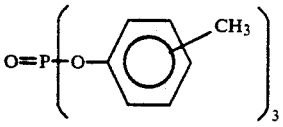
Solvent (Solv-4):
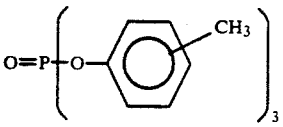
Solvent (Solv-5):

-continued $$\begin{array}{l} COOC_8H_{17} \\ | \\ (CH_2)_8 \\ | \\ COOC_8H_{17} \end{array}$$

Solvent (Solv-6):

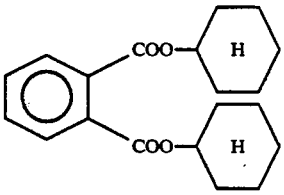

Each of Samples 1A to 1F was imagewise exposed to light and subjected to a running test using a paper processing machine according to the following processing schedule.

| Processing Step | Temp. (°C.) | Time (sec) | Rate of Replenishment (ml/m²) | Volume of Tank (l) |
|---|---|---|---|---|
| Color Development | 35 | 45 | 161 | 10 |
| Bleach-Fix | 30–35 | 45 | 150 | 10 |
| Rinsing (1) | 30–35 | 30 | — | 5 |
| Rinsing (2) | 30–35 | 30 | — | 5 |
| Rinsing (3) | 30–35 | 30 | 350 | 5 |
| Drying | 70–80 | 60 | | |

Rinsing was carried out in a counter-flow system running from tank (3) toward tank (1).

Each processing solution had the following formulation:

| | Running Solution | Replenisher |
|---|---|---|
| Color Developing Solution: | | |
| Water | 800 ml | 800 ml |
| Ethylenediamine-N,N,N',N'-tetramethylene-phosphonic acid | 3.0 g | 3.0 g |
| Potassium bromide | 0.010 g | — |
| Triethanolamine | 8.0 g | 12.0 g |
| Sodium chloride | 1.5 g | — |
| Potassium bromide | 25 g | 25 g |
| N-Ethyl-N-(β-methanesulfonamidoethyl)-3-methyl-4-aminoaniline sulfate | 5.0 g | 7.0 g |
| Hydrazinodiacetic acid | 5.5 g | 7.0 g |
| Fluorescent brightening agent ("WHITEX 4" produced by Sumitomo Chemical Co., Ltd.) | 1.0 g | 1.5 g |
| Water to make | 1000 ml | 1000 ml |
| pH (25° C.) | 10.05 | 10.45 |
| Bleach-Fix Bath: | | |
| (Running solution and replenisher had the same formulation) | | |
| Water | | 400 ml |
| Ammonium thiosulfate (70% aq. solu.) | | 120 ml |
| Sodium sulfite | | 20 g |
| Ammonium (ethylenediaminetetraacetato)iron (III) | | 65 g |
| Disodium ethylenediaminetetraacetate | | 2 g |
| Water to make | | 1000 ml |
| pH (25° C.) (adjusted with glacial acetic acid) | | 5.00 |
| Rinsing Solution: | | |
| (Running solution and replenisher had the same formulation) | | |
| Deionized water with calcium and magnesium ions each reduced to 3 ppm or less. | | |

An overflow of the bleach-fix bath was pooled, and when its volume reached twice the tank volume (i.e., 20 l), Regenerant A having the following formulation (per liter of the overflow) was added thereto. The thus regenerated overflow was utilized as a replenisher.

| Regenerant A: | |
|---|---|
| Ammonium thiosulfate (70% w/v aq. solu.) | 25 ml |
| Sodium sulfite | 10 g |
| Ammonium (ethylenediaminetetra-acetato)iron (III) dihydrate | 15 g |
| Ethylenediaminetetraacetic acid | 1 g |
| Glacial acetic acid to adjust to a pH of 5.00 | |

The above-described regeneration operation was repeated 20 times and, at this point, each of Samples 1A to 1F was wedgewise exposed to light and processed according to the same processing schedule as described above. The regeneration rate was obtained as 100%.

Desilvering performance, cyan color reproduction, and cyan discoloration were evaluated according to the following test methods.

1) Desilvering Performance

The maximum density area of the processed sample was analyzed with fluorescent X-rays to determine a residual silver amount.

2) Cyan Color Reproduction

The cyan density ($D_{R0}$) of the processed sample was measured. Then, the sample was immersed in a bleaching solution which comprises 100 g of EDTA NaF, 50 g of potassium bromide, 6 ml of 20% aqueous ammonia solution and 1000 ml of water and has pH of 5.9 to 6.1, at 25° C. for 4 minutes, and the cyan density ($D_{R1}$) was again measured. The bleaching solution may be replaced by that of "CN-16 $N_2$" produced by Fuji Photo Film Co., Ltd. A rate of color formation was calculated from $D_{R0}$ (before rebleaching) at the area of $D_{R1}=2.0$ (after rebleaching) according to equation:

$$\text{Rate of Color Formation (\%)} = \frac{D_{R0}\,(D_{R1} = 2.0)}{2.0} \times 100$$

3) Cyan Discoloration

The processed sample was preserved at 80° C. for 2 months, and reduction of cyan density in the area whose initial cyan density (before preservation) was 2.0 was measured.

Results of these evaluations are shown in Table 2 below.

TABLE 2

| Run No. | Sample No. | Degree of Swelling | Residual Amount of Ag ($\mu/cm^2$) | Rate of Cyan Color Formation (%) | Cyan Discoloration | Remark |
|---|---|---|---|---|---|---|
| 1 | 1A | 2.0 | 13 | 89 | −0.18 | Comparison |
| 2 | 1B | 2.5 | 5 | 98 | −0.15 | Invention |
| 3 | 1C | 3.0 | 2 | 100 | −0.13 | Invention |
| 4 | 1D | 3.5 | 2 | 100 | −0.13 | Invention |
| 5 | 1E | 4.0 | 2 | 100 | −0.13 | Invention |
| 6 | 1F | 4.5 | 16 | 91 | −0.19 | Comparison |

The samples having the specific degree of swelling according to the present invention showed improvements in desilvering properties, color reproducibility, and resistance to cyan thermal discoloration (Run Nos. 2 to 5).

EXAMPLE 2

On a polyethylene-laminated (on both sides) paper support having been subjected to a corona discharge treatment, layers shown below were coated in the order listed to prepare a multi-layer color paper. Coating compositions were prepared as follows.

Preparation of First Layer Coating Composition

To a mixture of 60.0 g of a yellow coupler (ExY) and 28.0 g of a discoloration inhibitor (Cpd-1) were added 150 ml of ethyl acetate, 1.0 ml of a solvent (Solv-3), and 3.0 ml of a solvent (Solv-4) to form a solution. The resulting solution was added to 450 ml of a 10% gelatin aqueous solution containing sodium dodecylbenzenesulfonate and dispersed in a ultrasonic homogenizer. The resulting dispersion was mixed with 420 g of a silver chlorobromide emulsion (silver bromide content: 0.7 mol %) containing a blue-sensitive sensitizing dye shown below to prepare a coating composition for a the first layer.

Coating compositions for second to seventh layers were prepared in the same manner as for the 1st layer coating composition. To each coating composition, 1,2-bis(vinylsulfonyl)ethane was added as a gelatin hardening agent.

Spectral sensitizing dyes used in each light-sensitive layer are shown below.

Blue-Sensitive Layer:

Anhydro-5,5'-dichloro-3,3'-disulfoethylthiacyanine hydroxide ($2\times10^{-4}$ mol/mol-AgX)

Green-Sensitive Layer:

Anhydro-9-ethyl-5,5'-diphenyl-3,3'-disulfoethyloxacarbocyanine hydroxide ($5\times10^{-4}$ mol/mol-AgX)

Red-Sensitive Layer:

3,3'-Diethyl-5-methoxy-9,11-neopentylthiadicarbocyanine iodide ($2\times10^{-4}$ mol/mol-AgX)

Each of the emulsion layers contained, as a stabilizer, a 7:2:1 (by mole) mixture of 1-(2-acetaminophenyl)-5-mercaptotetrazole, 1-phenyl-5-mercaptotetrazole, and 1-(p-methoxyphenyl)-5-mercaptotetrazole.

Further, [3-carboxy-5-hydroxy-4-(3-(3-carboxy-5-oxo-1-(2,5-bisulfonatophenyl)-2-pyrazolin-4-ylidene)-1-propenyl)-1-pyrazolyl]benzene-2,5-disulfonate disodium salt, N,N'-(4,8-dihydroxy-9,10-dioxo-3,7-disulfonatoanthracene-1,5-diyl)bis(aminomethanesulfonate) tetrasodium salt, and [3-cyano-5-hydroxy-4-(3-(3-cyano-5-oxo-1-(4-sulfonatophenyl)-2-pyrazolin-4-ylidene)-1-pentanyl)-1-pyrazolyl]benzene-4-sulfonate sodium salt were used as anti-irradiation dyes.

The layer structure of the multi-layer color paper is shown below. The amount of a silver halide emulsion is reduced to silver coverage.

Layer Structure

Support

Polyethylene-laminated paper, the polyethylene layer on the size to be coated with a first layer contained a white pigment ($TiO_2$) and a bluing dye (ultramarine), and the surface of the support having been subjected to a corona discharge treatment.

| | Amount ($g/m^2$) |
|---|---|
| First Layer (Blue-Sensitive Layer): | |
| Silver chlorobromide emulsion (cubic; mean grain size: 0.9 $\mu$m; AgBr content: 0.7 mol %) | 0.35 |
| Gelatin | 1.80 |
| Yellow coupler (ExY) | 0.60 |
| Discoloration inhibitor (Cpd-1) | 0.28 |
| Solvent (Solv-3) | 0.01 |
| Solvent (Solv-4) | 0.03 |
| Second Layer (Color Mixing Preventive Layer): | |
| Gelatin | 0.80 |
| Color mixing inhibitor (Cpd-2) | 0.055 |
| Solvent (Solv-1) | 0.03 |
| Solvent (Solv-2) | 0.15 |
| Third Layer (Green-Sensitive Layer): | |
| Silver chlorobromide emulsion (cubic; mean grain size: 0.45 $\mu$m; AgBr content: 0.7 mol %) | 0.25 |
| Gelatin | 1.86 |
| Magenta coupler (ExM) | 0.27 |
| Discoloration inhibitor (Cpd-3) | 0.17 |
| Discoloration inhibitor (Cpd-4) | 0.10 |
| Solvent (Solv-1) | 0.2 |
| Solvent (Solv-2) | 0.03 |
| Fourth Layer (Color Mixing Preventive Layer): | |
| Gelatin | 1.70 |
| Color mixing inhibitor (Cpd-2) | 0.065 |
| Ultraviolet absorbent (UV-1) | 0.45 |
| Ultraviolet absorbent (UV-2) | 0.23 |
| Solvent (Solv-1) | 0.05 |
| Solvent (Solv-2) | 0.05 |
| Fifth Layer (Red-Sensitive Layer): | |
| Silver chlorobromide emulsion (cubic; mean grain size: 0.5 $\mu$m; AgBr content: 4 mol %) | 0.25 |
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |
| Color formation accelerator (Cpd-5) | 0.15 |
| Sixth Layer (Ultraviolet Absorbing Layer): | |
| Gelatin | 0.70 |
| Ultraviolet absorbent (UV-1) | 0.26 |
| Ultraviolet absorbent (UV-2) | 0.07 |
| Solvent (Solv-1) | 0.30 |
| Solvent (Solv-2) | 0.09 |
| Seventh Layer (Protective Layer): | |
| Gelatin | 1.7 |

Couplers and other additives used above are as follows.

Discoloration Inhibitor (Cpd-1):

-continued

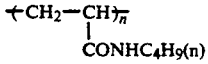

Average Mol. Wt.: 80,000

Color Mixing Inhibitor (Cpd-2):
2,5-Di-t-octylhydroquinone
Discoloration Inhibitor (Cpd-3):
7,7'-Dihydroxy-4,4,4',4'-tetramethyl-2,2'-spirochroman
Discoloration Inhibitor (Cpd-4):
N-(4-Dodecyloxyphenyl)-morpholine
Color Formation Accelerator (Cpd-5):
p-(p-Toluenesulfonamido)phenyldodecane
Solvent (Solv-1):
Di(2-ethylhexyl) phthalate
Solvent (Solv-2):
Dibutyl phthalate
Solvent (Solv-3):
Di(i-nonyl) phthalate
Solvent (Solv-4):
N,N-Diethylcarbonamidomethoxy-2,4-di-t-amylbenzene
Ultraviolet Absorbent (UV-1):
2-(2-Hydroxy-3,5-di-t-amylphenyl)benzotriazole
Ultraviolet Absorbent (UV-2):
2-(2-Hydroxy-3,5-di-t-butylphenyl)benzotriazole
Yellow Coupler (ExY):

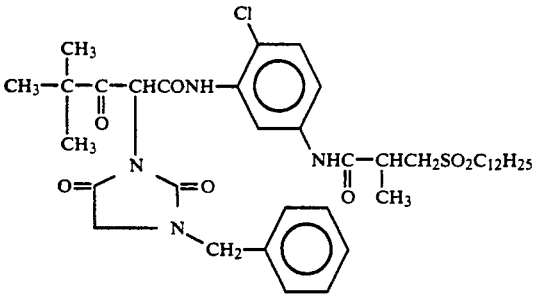

Magenta Coupler (ExM):

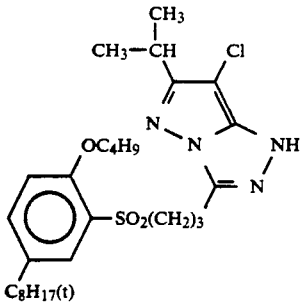

Cyan Coupler (ExC-1):

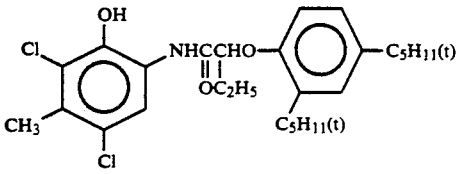

Cyan Coupler (ExC-2):

-continued

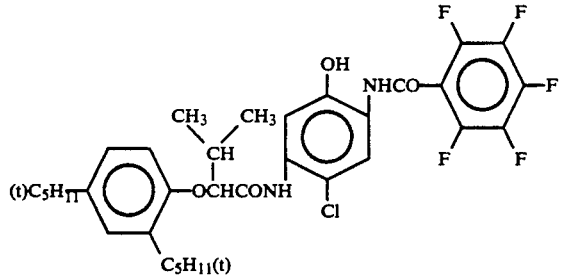

In the sample preparation, the silver coverage of the first, third, and fifth layers and the degree of swelling (as defined above) of the photographic layers were varied as shown in Table 3 below. The resulting samples were designated Samples 2A to 2H.

TABLE 3

| Sample No. | Degree of Swelling | Silver Coverage ($g/m^2$) First Layer | Third Layer | Fifth Layer | Total Layer |
|---|---|---|---|---|---|
| 2A | 2.0 | 0.25 | 0.25 | 0.25 | 0.75 |
| 2B | 3.5 | 0.25 | 0.25 | 0.25 | 0.75 |
| 2C | 2.0 | 0.25 | 0.15 | 0.25 | 0.65 |
| 2D | 3.5 | 0.25 | 0.15 | 0.25 | 0.65 |
| 2E | 4.0 | 0.25 | 0.15 | 0.25 | 0.65 |
| 2F | 2.0 | 0.20 | 0.15 | 0.20 | 0.55 |
| 2G | 3.5 | 0.20 | 0.15 | 0.20 | 0.55 |
| 2H | 3.5 | 0.30 | 0.25 | 0.30 | 0.85 |

Each of Samples 2A to 2H was imagewise exposed to light and continuously processed according to the following schedule:

| Processing Step | Temp. (°C.) | Time (sec) | Rate of Replenishment ($ml/m^2$) | Volume of Tank (l) |
|---|---|---|---|---|
| Color Development | 38 | 45 | 80 | 4 |
| Bleach-Fix | 30–36 | 30 | 200 | 4 |
| Washing (1) | 30–37 | 30 | — | 2 |
| Washing (2) | 30–37 | 30 | — | 2 |
| Washing (3) | 30–37 | 30 | 364 | 2 |
| Drying | 70–85 | 60 | | |

Washing was carried out in a counter-flow system running from tank (3) toward tank (1).

Each processing solution had the following formulation:

| | Running Solution | Replenisher |
|---|---|---|
| Color Developing Solution: | | |
| Triethanolamine | 10 g | 10 g |
| Ethylenediamine-N,N,N',N'-tetramethylenephosphonic acid | 3.0 g | 3.0 g |
| Potassium chloride | 3.1 g | — |
| Potassium bromide | 0.015 g | — |
| Hydrazinodiacetic acid | 3.5 g | 7.0 g |
| N-Ethyl-N-(β-methanesulfonamidoethyl)-3-methyl-4-aminoaniline sulfate | 4.75 g | 9.0 g |
| Fluorescent brightening agent ("WHITEX 4" produced by Sumitomo Chemical Co., Ltd.) | 1.25 g | 2.5 g |
| Potassium carbonate | 25 g | 25 g |
| Water to make | 1000 ml | 1000 ml |
| pH | 10.00 | 10.60 |
| Bleach-Fix Bath: | | |
| (Running solution and replenisher had the same formulation) | | |

-continued

| | Running Solution | Replenisher |
|---|---|---|
| Ammonium thiosulfate (70 w/v %) | | 100 ml |
| Ammonium (ethylenediaminetetraacetato)iron (III) | | 55 g |
| Ammonium sulfite | | 25 g |
| Ethylenediaminetetraacetic acid | | 1.5 g |
| Nitric acid (67%) | | 24 g |
| Water to make | | 1000 ml |
| pH | | 5.20 |
| Washing Water: | | |
| Deionized water having calcium and magnesium ions reduced each to 3 ppm or less. | | |

The overflow of the bleach-fix bath was pooled, and when its volume reached 10 l, a given amount of silver was recovered therefrom by the use of the electrolytic silver recovering apparatus shown in FIGS. 1 and 2 of JP-B-57-16345 under the same conditions as used in Example 1 of the reference supra. Then, Regenerant B having the following formulation (per liter of the overflow) was added thereto. The thus treated overflow was used as a regenerated replenisher. The above-described regeneration operation was repeated 20 times.

| Regenerant B: | |
|---|---|
| Ammonium thiosulfate (70% w/v aq. solu.) | 20 ml |
| Sodium bisulfite | 12 g |
| Ammonium (ethylenediaminetetra-acetato)iron (III) dihydrate | 15 g |
| Ethylenediaminetetraacetic acid | 2 g |
| Glacial acetic acid to adjust to a pH of 5.20 | |

Desilvering properties, color reproducibility, and cyan discoloration were evaluated in the same manner as in Example 1, and the results obtained are shown in Table 4.

TABLE 4

| Run No. | Sample No. | Degree of Swelling | Ag Coverage ($\mu g/cm^2$) | Residual Amount of Ag ($\mu/cm^2$) | Rate of Cyan Color Formation (%) | Cyan Discoloration | Remark |
|---|---|---|---|---|---|---|---|
| 1 | 2A | 2.0 | 0.75 | 19 | 83 | −0.18 | Comparison |
| 2 | 2B | 3.5 | 0.75 | 7 | 95 | −0.13 | Invention |
| 3 | 2C | 2.0 | 0.65 | 18 | 84 | −0.17 | Comparison |
| 4 | 2D | 3.5 | 0.65 | 4 | 99 | −0.11 | Invention |
| 5 | 2E | 4.0 | 0.65 | 4 | 99 | −0.11 | Invention |
| 6 | 2F | 2.0 | 0.55 | 16 | 85 | −0.17 | Comparison |
| 7 | 2G | 3.5 | 0.55 | 2 | 100 | −0.11 | Invention |
| 8 | 2H | 3.5 | 0.85 | 21 | 80 | −0.20 | Comparison |

As can be seen from Table 4, the present invention (Run Nos. 2, 4, 5, and 7) achieves improvements in desilvering performance, color reproducibility, and resistance to cyan discoloration. These effects are particularly remarkable in silver halide light-sensitive materials having a silver coverage of not more than 0.65 $g/m^2$ (Run Nos. 4, 5, and 7).

As described above, the present invention provides a processing system which permits of repeated regeneration of a bleach-fix bath and reuse as a replenisher without causing insufficient desilvering, poor color reproduction, and deterioration of image preservability to thereby provide a processed silver halide color photographic material having excellent image quality.

While the invention has been described in detail and with reference to specific embodiments thereof, it will be apparent to one skilled in the art that various changes and modifications can be made therein without departing from the spirit and scope thereof.

What is claimed is:

1. A method for continuously processing an imagewise exposed silver halide color photographic material, comprising the steps of:

(a) color developing said photographic material in a color developing solution;

(b) bleach-fixing said photographic material using a bleach-fix bath and supplying a replenisher to the bleach-fix bath to result in an overflow of from 30 to 500 $ml/m^2$ of the photographic material processed; and (c) at least one of washing said photographic material with water and stabilizing said photographic material; wherein (i) said bleach-fixing step further comprising collecting the bleach-fix bath overflow, regenerating the collected bleach-fix bath overflow by adding thereto a regenerant to produce a regenerated bleach-fix bath and reusing said regenerated bleach-fix bath in step (b) as a replenisher to the bleach-fix bath, the regenerant comprising 0.1 to 50 g/l of a bleaching agent, 2 to 50 g/l of a fixing agent and 5 to 50 g/l of a preservative;

(ii) the regeneration rate defined as the amount of bleach-fix overflow used for regeneration divided by the total amount of overflow multiplied by 100% is more than 90%;

(iii) said photographic layers of said silver halide color photographic material have a degree of swelling of from about 2.5 to 4.0; and (iv) said silver halide color photographic material has a silver coverage of less than about 0.80 $g/m^2$.

2. A method as claimed in claim 1, wherein the photographic layers of said silver halide color photographic material have a degree of swelling of from 3.0 to 4.0.

3. A method as claimed in claim 1, wherein said silver halide color photographic material has a silver coverage of from about 0.40 to 0.65 $g/m^2$.

4. A method as claimed in claim 1, wherein said silver halide color photographic material comprises at least three light-sensitive layers differing in color sensitivity, each of said light-sensitive layers having a silver coverage of from about 0.1 to 0.3 $g/m^2$.

5. A method as claimed in claim 1, wherein said silver halide color photographic material comprises at least one cyan coupler represented by formula (I):

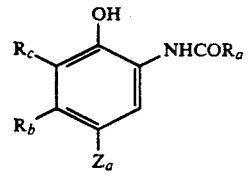

(I)

wherein $R_a$ represents an alkyl group, a cycloalkyl group, an aryl group, an amino group, or a heterocyclic group; $R_b$ represents an acylamino group or an alkyl group having 2 or more carbon atoms; $R_c$ represents a hydrogen atom, a halogen atom, an alkyl group, or an alkoxy group; $R_c$ and $R_b$ may be taken together to form a ring; and $Z_a$ represents a hydrogen atom, a halogen atom, or a group releasable on reacting with an oxidation product of an aromatic primary amine color developing agent.

6. A method as claimed in claim 1, wherein a color developing solution substantially contains no benzyl alcohol.

7. A method as claimed in claim 1, wherein said silver halide color photographic material comprises a silver halide emulsion having a silver chloride content of 90–100 mol %.

8. A method as claimed in claim 1, wherein a carbonyl bisulfite addition compound is added to the collected bleach-fix bath overflow to provide the regenerated bleach-fix bath.

9. A method as claimed in claim 1, wherein a bleaching agent, a fixing agent, a preservative and an acid are added to the collected bleach-fix bath overflow to produce the regenerated bleach-fix bath.

10. A method for continuously processing an imagewise exposed silver halide color photographic material, comprising the steps of (a) color developing said photographic material in a color developing solution;

(b) bleach-fixing said photographic material using a bleach-fix bath and supplying a replenisher to the bleach-fix bath to result in an overflow of from 30 to 500 ml/m$^2$ of the photographic material processed; and (c) at least one of washing said photographic material with water and stabilizing said photographic material; wherein (i) said bleach-fixing step further comprising collecting the bleach-fix bath overflow, regenerating the collected bleach-fix bath overflow by adding thereto a regenerant to produce a regenerated bleach-fix bath and reusing said regenerated bleach-fix bath in step (b) as a replenisher to the bleach-fix bath, the regenerant comprising 0.1 to 50 g/l of a bleaching agent, 2 to 50 g/l of a fixing agent and 5 to 50 g/l of a preservative;

(ii) the regeneration rate defined as the amount of bleach-fix overflow used for regeneration divided by the total amount of overflow multiplied by 100% is more than 90%;

(iii) components accumulated in the bleach-fix bath during the continuous processing are not removed from the regenerated bleach-fix bath;

(iv) said photographic layers of said silver halide color photographic material have a degree of swelling of from about 2.5 to 4.0; and (v) said silver halide color photographic material has a silver coverage of less than about 0.8 g/m$^2$.

* * * * *